US008758107B2

(12) United States Patent
Cole

(10) Patent No.: US 8,758,107 B2
(45) **Date of Patent: *Jun. 24, 2014**

(54) GAMING SYSTEM, GAMING DEVICE, AND METHOD PROVIDING A CARD GAME HAVING A DISCARDED CARD RE-INSERTION FEATURE

(71) Applicant: IGT, Las Vegas, NV (US)

(72) Inventor: James Milton Cole, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/925,288

(22) Filed: Jun. 24, 2013

(65) Prior Publication Data

US 2013/0288765 A1 Oct. 31, 2013

Related U.S. Application Data

(63) Continuation of application No. 13/327,191, filed on Dec. 15, 2011, now Pat. No. 8,475,253.

(51) Int. Cl.
*A63F 1/00* (2006.01)

(52) U.S. Cl.
USPC ..... 463/13; 463/11; 463/16; 273/138.1; 273/292

(58) Field of Classification Search
CPC ..... A63F 1/00; A63F 1/13; G07F 17/3293; G07F 17/3267
USPC ..... 463/9–13; 273/292
See application file for complete search history.

(56) References Cited

U.S. PATENT DOCUMENTS

| | | | |
|---|---|---|---|
| 1,527,929 | A | 2/1925 | Simons |
| 3,876,208 | A | 4/1975 | Wachtler et al. |
| 3,998,462 | A | 12/1976 | Goott |
| 4,363,485 | A | 12/1982 | Edwall |
| 4,448,419 | A | 5/1984 | Telnaes |
| 4,582,324 | A | 4/1986 | Koza et al. |
| 4,624,459 | A | 11/1986 | Kaufman |
| 4,648,604 | A | 3/1987 | Horan |
| 4,679,143 | A | 7/1987 | Hagiwara |

(Continued)

FOREIGN PATENT DOCUMENTS

| | | |
|---|---|---|
| AU | 1999/017318 | 2/1999 |
| EP | 0 945 837 | 9/1999 |

(Continued)

*Primary Examiner* — William Brewster
*Assistant Examiner* — Alex F. R. P. Rada, II
(74) *Attorney, Agent, or Firm* — Neal, Gerber & Eisenberg LLP

(57) ABSTRACT

Various embodiments of the present disclosure provide a gaming system, gaming device, and method providing a card game having a discarded card re-insertion feature. Upon receiving a primary wager, the gaming system provides a play of a card game in which the gaming system enables the player to select one or more cards in a player's hand to discard and in which, if the gaming system discards any of the cards in the player's hand, the gaming system replaces at least one of the discarded cards with a replacement card. The gaming system enables the player to place an optional secondary wager to cause the gaming system to activate the discarded card re-insertion feature. If the discarded card re-insertion feature is active, the gaming system enables the player to cause zero or at least one of any discarded cards to be re-inserted into the player's hand.

20 Claims, 12 Drawing Sheets

(56) References Cited

U.S. PATENT DOCUMENTS 4,743,022 A * 5/1988 Wood ..... 463/13
4,743,024 A 5/1988 Helm et al.
4,756,532 A 7/1988 Kamille
4,781,377 A 11/1988 McVean et al.
4,836,553 A 6/1989 Suttle et al.
4,838,552 A 6/1989 Hagiwara
4,856,787 A 8/1989 Itkis
4,861,041 A 8/1989 Jones et al.
4,926,327 A 5/1990 Sidley
4,948,128 A 8/1990 Emery, II et al.
4,948,134 A 8/1990 Suttle et al.
4,964,642 A 10/1990 Kamille
4,991,848 A 2/1991 Greenwood et al.
5,010,995 A 4/1991 Okada
5,013,049 A 5/1991 Tomaszewski
5,014,988 A 5/1991 Mirando et al.
5,019,973 A 5/1991 Wilcox et al.
5,022,653 A 6/1991 Suttle et al.
5,033,744 A 7/1991 Bridgeman et al.
5,042,818 A 8/1991 Weingardt
5,046,735 A 9/1991 Hamano et al.
5,067,724 A 11/1991 Rinkavage
5,085,436 A 2/1992 Bennett
5,092,598 A 3/1992 Kamille
5,098,107 A 3/1992 Boylan et al.
5,100,137 A 3/1992 Fulton
5,116,055 A 5/1992 Tracy
5,118,109 A 6/1992 Gumina
5,118,114 A 6/1992 Tucci
5,123,649 A 6/1992 Tiberio
5,154,429 A 10/1992 LeVasseur
5,158,293 A 10/1992 Mullins
5,159,549 A 10/1992 Hallman, Jr. et al.
5,167,413 A 12/1992 Fulton
5,178,390 A 1/1993 Okada
5,178,395 A 1/1993 Lovell
5,188,363 A 2/1993 Marnell, II et al.
5,248,142 A 9/1993 Breeding
5,251,897 A 10/1993 Fulton
5,255,915 A 10/1993 Miller
5,257,789 A 11/1993 LeVasseur
5,265,874 A 11/1993 Dickinson et al.
5,275,400 A 1/1994 Weingardt et al.
5,280,909 A 1/1994 Tracy
5,280,915 A 1/1994 Groussman
5,286,023 A 2/1994 Wood
5,288,082 A 2/1994 Marquez
5,294,120 A 3/1994 Schultz
5,308,065 A 5/1994 Bridgeman et al.
5,322,295 A 6/1994 Cabot et al.
5,324,041 A 6/1994 Boylan et al.
5,332,228 A 7/1994 Schultz
5,342,049 A 8/1994 Wichinsky et al.
5,344,144 A 9/1994 Canon
5,356,140 A 10/1994 Dabrowski et al.
5,374,067 A 12/1994 Jones
5,377,973 A 1/1995 Jones et al.
5,380,012 A 1/1995 Jones et al.
5,382,025 A 1/1995 Sklansky et al.
5,401,023 A 3/1995 Wood
5,411,257 A 5/1995 Fulton
5,413,353 A 5/1995 Demarest et al.
5,415,404 A 5/1995 Joshi et al.
5,423,539 A 6/1995 Nagao
5,431,408 A 7/1995 Adams
5,437,451 A 8/1995 Fulton
5,451,054 A 9/1995 Orenstein
5,486,005 A 1/1996 Neal
5,489,101 A 2/1996 Moody
5,511,781 A 4/1996 Wood et al.
5,524,888 A 6/1996 Heidel
5,531,440 A 7/1996 Dabrowski et al.
5,531,441 A 7/1996 Dabrowski et al.
5,531,448 A 7/1996 Moody
5,542,669 A 8/1996 Charron et al.
5,544,892 A 8/1996 Breeding
5,570,885 A 11/1996 Ornstein
5,573,249 A 11/1996 Johnson
5,586,766 A 12/1996 Forte et al.
5,630,753 A 5/1997 Fuchs
5,636,842 A 6/1997 Cabot et al.
5,643,088 A 7/1997 Vaughn et al.
5,645,486 A 7/1997 Nagao et al.
5,653,444 A 8/1997 Dahl
5,655,961 A 8/1997 Acres et al.
5,657,993 A 8/1997 Merlino et al.
5,664,998 A 9/1997 Seelig et al.
5,678,821 A 10/1997 Hedman
5,697,614 A 12/1997 Potter et al.
5,711,525 A 1/1998 Breeding
5,718,431 A 2/1998 Ornstein
5,722,891 A 3/1998 Inoue
5,725,216 A 3/1998 Jones
5,732,950 A 3/1998 Moody
5,755,621 A 5/1998 Marks et al.
5,772,506 A 6/1998 Marks et al.
5,775,692 A 7/1998 Watts et al.
5,779,545 A 7/1998 Berg et al.
5,788,241 A 8/1998 Ung
5,788,573 A 8/1998 Baerlocher et al.
5,788,574 A 8/1998 Ornstein et al.
5,794,934 A 8/1998 Malcolm
5,799,946 A 9/1998 Groussman
5,806,045 A 9/1998 Biorge et al.
5,806,855 A 9/1998 Cherry
5,807,172 A 9/1998 Piechowiak
5,816,914 A 10/1998 Wichinsky
5,816,915 A 10/1998 Kadlic
5,816,916 A 10/1998 Moody
5,820,460 A 10/1998 Fulton
5,823,873 A 10/1998 Moody
5,823,874 A 10/1998 Adams
5,833,536 A 11/1998 Davids et al.
5,833,537 A 11/1998 Barrie
5,833,538 A 11/1998 Weiss
5,839,730 A 11/1998 Pike
5,839,732 A 11/1998 Guidi
5,845,907 A 12/1998 Wells
5,848,932 A 12/1998 Adams
5,851,148 A 12/1998 Brune et al.
5,855,515 A 1/1999 Pease et al.
5,868,618 A 2/1999 Netley et al.
5,868,619 A 2/1999 Wood et al.
5,882,259 A 3/1999 Holmes, Jr. et al.
5,882,260 A 3/1999 Marks et al.
5,882,261 A 3/1999 Adams
5,897,436 A 4/1999 Singer et al.
5,902,184 A 5/1999 Bennett et al.
5,902,983 A 5/1999 Crevelt et al.
5,908,353 A 6/1999 Andrews
5,910,048 A 6/1999 Feinberg
5,911,418 A 6/1999 Adams
5,911,419 A 6/1999 Delaney et al.
5,921,550 A 7/1999 Awada
5,934,998 A 8/1999 Forte et al.
5,944,314 A 8/1999 Stavinsky
5,947,820 A 9/1999 Morro et al.
5,947,821 A 9/1999 Stone
5,947,822 A 9/1999 Weiss
5,951,012 A 9/1999 Feola
5,951,397 A 9/1999 Dickinson
5,954,335 A 9/1999 Moody
5,957,774 A 9/1999 Holmes, Jr. et al.
5,964,464 A 10/1999 Jones
5,967,893 A 10/1999 Lawrence et al.
5,967,894 A 10/1999 Kinoshita et al.
5,971,849 A 10/1999 Falciglia
5,975,529 A 11/1999 de Keller
5,976,016 A 11/1999 Moody et al.
5,980,384 A 11/1999 Barrie
5,984,309 A 11/1999 Santin
5,988,643 A 11/1999 Awada
5,997,002 A 12/1999 Goldman
5,997,401 A 12/1999 Crawford

(56) References Cited

U.S. PATENT DOCUMENTS 6,004,207 A 12/1999 Wilson, Jr. et al.
6,007,066 A 12/1999 Moody
6,007,424 A 12/1999 Evers et al.
6,012,719 A 1/2000 Webb
6,012,720 A 1/2000 Webb
6,019,374 A 2/2000 Breeding
6,032,955 A 3/2000 Luciano et al.
6,033,307 A 3/2000 Vancura
6,039,648 A 3/2000 Guinn et al.
6,045,129 A 4/2000 Cooper et al.
6,048,267 A 4/2000 Wichinsky
6,050,568 A 4/2000 Hachquet
6,056,641 A 5/2000 Webb
6,059,289 A 5/2000 Vancura
6,059,658 A 5/2000 Mangano et al.
6,062,980 A 5/2000 Luciano
6,062,981 A 5/2000 Luciano, Jr.
6,077,163 A 6/2000 Walker et al.
6,079,711 A 6/2000 Wei et al.
6,089,976 A 7/2000 Schneider et al.
6,089,977 A 7/2000 Bennett
6,089,978 A 7/2000 Adams
6,093,100 A 7/2000 Singer et al.
6,098,985 A 8/2000 Moody
6,102,400 A 8/2000 Scott et al.
6,106,393 A 8/2000 Sunaga et al.
6,110,040 A 8/2000 Sanduski et al.
6,110,041 A 8/2000 Walker et al.
6,110,043 A 8/2000 Olsen
6,120,031 A 9/2000 Adams
6,120,378 A 9/2000 Moody et al.
6,126,541 A 10/2000 Fuchs
6,126,542 A 10/2000 Fier
6,129,357 A 10/2000 Wichinsky
6,131,907 A 10/2000 Nucifora et al.
6,131,908 A 10/2000 Palmer
6,132,311 A 10/2000 Williams
6,135,453 A 10/2000 Srichayaporn
6,135,882 A 10/2000 Kadlic
6,135,883 A 10/2000 Hachquet
6,142,873 A 11/2000 Weiss et al.
6,146,271 A 11/2000 Kadlic
6,146,273 A 11/2000 Olsen
6,149,156 A 11/2000 Feola
6,149,157 A 11/2000 Suan
6,149,521 A 11/2000 Sanduski
6,155,568 A 12/2000 Franklin
6,155,925 A 12/2000 Giobbi et al.
6,159,095 A 12/2000 Frohm et al.
6,159,097 A 12/2000 Gura
6,164,652 A 12/2000 Lauretta et al.
6,168,523 B1 1/2001 Piechowiak et al.
6,173,955 B1 1/2001 Perrie et al.
6,174,233 B1 1/2001 Sunaga et al.
6,176,781 B1 1/2001 Walker et al.
6,179,293 B1 1/2001 Hedman
6,179,711 B1 1/2001 Yoseloff
6,186,894 B1 2/2001 Mayeroff
6,190,254 B1 2/2001 Bennett
6,190,255 B1 2/2001 Thomas et al.
6,193,606 B1 2/2001 Walker et al.
6,203,428 B1 3/2001 Giobbi et al.
6,203,429 B1 3/2001 Demar et al.
6,206,374 B1 3/2001 Jones
6,206,780 B1 3/2001 Awada
6,220,959 B1 4/2001 Holmes, Jr. et al.
6,220,960 B1 4/2001 Kryzhanovsky
6,224,055 B1 5/2001 Walker et al.
6,224,483 B1 5/2001 Mayeroff
6,224,484 B1 5/2001 Okuda et al.
6,227,969 B1 5/2001 Yoseloff
6,227,971 B1 5/2001 Weiss
6,231,442 B1 5/2001 Mayeroff
6,231,445 B1 5/2001 Acres
6,234,897 B1 5/2001 Frohm et al.
6,237,913 B1 5/2001 Kamille
6,237,916 B1 5/2001 Webb
6,238,287 B1 5/2001 Komori et al.
6,248,016 B1 6/2001 Walker et al.
6,250,685 B1 6/2001 Walker et al.
6,251,013 B1 6/2001 Bennett
6,254,481 B1 7/2001 Jaffe
6,254,482 B1 7/2001 Walker et al.
6,257,979 B1 7/2001 Walker et al.
6,270,078 B1 8/2001 Leone et al.
6,270,079 B1 8/2001 Chamberlain
6,270,405 B1 8/2001 Ferguson
6,270,409 B1 8/2001 Shuster
6,283,855 B1 9/2001 Bingham
6,290,603 B1 9/2001 Luciano, Jr.
RE37,414 E 10/2001 Harlick
6,299,170 B1 10/2001 Yoseloff
6,299,532 B1 10/2001 Smith
6,302,791 B1 10/2001 Frohm et al.
6,305,686 B1 10/2001 Perrie et al.
6,309,300 B1 10/2001 Glavich
6,311,978 B1 11/2001 Moody
6,315,662 B1 11/2001 Jorasch et al.
6,315,664 B1 11/2001 Baerlocher et al.
6,322,078 B1 11/2001 Adams
6,322,445 B1 11/2001 Miller
6,328,649 B1 12/2001 Randall et al.
6,332,614 B1 12/2001 Hesse
6,332,839 B2 12/2001 Walker et al.
6,334,613 B1 1/2002 Yoseloff
6,334,614 B1 1/2002 Breeding
6,336,859 B2 1/2002 Jones et al.
6,342,007 B1 1/2002 Wood et al.
6,345,823 B1 2/2002 Webb
6,347,996 B1 2/2002 Gilmore et al.
6,358,144 B1 3/2002 Kadlic et al.
6,358,147 B1 3/2002 Jaffe et al.
6,364,768 B1 4/2002 Acres et al.
6,368,214 B1 4/2002 Luciano
6,371,851 B1 4/2002 Singer et al.
6,375,570 B1 4/2002 Poole
6,379,245 B2 4/2002 De Keller
6,402,150 B1 6/2002 Jones
6,405,174 B1 6/2002 Walker et al.
6,406,023 B1 6/2002 Rowe
6,406,369 B1 6/2002 Baerlocher et al.
6,409,173 B1 6/2002 Tri
6,409,174 B1 6/2002 Demarest
6,416,407 B1 7/2002 Carrico et al.
6,419,578 B1 7/2002 Moody et al.
6,419,579 B1 7/2002 Bennett
6,422,940 B1 7/2002 Walker et al.
6,428,002 B1 8/2002 Baranauskas
6,428,412 B1 8/2002 Anderson et al.
6,435,506 B1 8/2002 Piccoli
6,439,993 B1 8/2002 O'Halloran
6,439,995 B1 8/2002 Hughs-Baird et al.
6,443,456 B1 9/2002 Gajor
6,443,837 B1 9/2002 Jaffe et al.
6,461,240 B1 10/2002 Perkins
6,468,156 B1 10/2002 Hughs-Baird et al.
6,471,208 B2 10/2002 Yoseloff et al.
6,474,645 B2 11/2002 Tarantino
6,478,675 B1 11/2002 Awada
6,488,580 B1 12/2002 Robb
6,491,584 B2 12/2002 Graham et al.
6,506,118 B1 1/2003 Baerlocher et al.
6,514,144 B2 2/2003 Riendeau et al.
6,517,074 B1 2/2003 Moody et al.
6,533,658 B1 3/2003 Walker et al.
6,547,242 B1 4/2003 Sugiyama et al.
6,561,898 B2 5/2003 Moody
6,568,680 B1 5/2003 Moody
6,569,013 B1 5/2003 Taylor
6,569,014 B2 5/2003 Walker et al.
6,569,016 B1 5/2003 Baerlocher
6,582,303 B1 6/2003 Weiss
6,592,456 B2 7/2003 Walker et al.
6,592,457 B1 7/2003 Frohm et al.

(56) References Cited

U.S. PATENT DOCUMENTS 6,595,852 B2 7/2003 Wang
6,605,001 B1 8/2003 Tarantino
6,607,437 B2 8/2003 Casey et al.
6,609,969 B1 8/2003 Luciano et al.
6,609,970 B1 8/2003 Luciano, Jr.
6,612,575 B1 9/2003 Cole et al.
6,620,045 B2 9/2003 Berman et al.
6,652,377 B1 11/2003 Moody
6,656,040 B1 12/2003 Brosnan et al.
6,669,559 B1 12/2003 Baerlocher et al.
6,672,959 B2 1/2004 Moody et al.
6,682,073 B2 1/2004 Bryant et al.
6,702,675 B2 3/2004 Poole et al.
6,712,693 B1 3/2004 Hettinger
6,729,621 B2 5/2004 Moody
6,729,961 B1 5/2004 Millerschone
6,739,970 B2 5/2004 Luciano
6,746,016 B2 6/2004 Perrie et al.
6,746,328 B2 6/2004 Cannon et al.
6,786,824 B2 9/2004 Cannon
6,802,778 B1 10/2004 Lemay et al.
6,837,793 B2 1/2005 McClintic
6,923,446 B2 8/2005 Snow
6,935,950 B2 8/2005 Tarantino
6,939,229 B2 9/2005 McClintic
6,955,356 B2 10/2005 Moody
6,964,418 B2 11/2005 Moody
6,991,538 B2 1/2006 Cannon
6,994,624 B2 2/2006 Gold et al.
7,000,921 B2 2/2006 Schultz
7,029,395 B1 4/2006 Baerlocher
7,052,392 B2 5/2006 Tessmer et al.
7,056,207 B2 6/2006 Walker et al.
7,137,628 B2 11/2006 Moody
7,156,397 B2 1/2007 Moody et al.
7,166,028 B2 1/2007 Fasbender et al.
7,192,344 B2 3/2007 Baerlocher
7,198,569 B2 4/2007 Wolf et al.
7,201,655 B2 4/2007 Walker et al.
7,222,857 B2 5/2007 Moody
7,222,858 B2 5/2007 Moody
7,247,092 B2 7/2007 Jarvis et al.
7,291,068 B2 11/2007 Bryant et al.
7,297,057 B2 11/2007 Gerrard et al.
7,318,774 B2 1/2008 Bryant et al.
7,329,179 B2 2/2008 Baerlocher
7,354,344 B2 4/2008 Paulsen et al.
7,357,714 B2 4/2008 Tessmer et al.
7,387,568 B2 6/2008 Millerschone
7,390,258 B2 6/2008 Millerschone
7,393,276 B2 7/2008 Millerschone
7,404,762 B2 7/2008 Moody
7,419,162 B2 9/2008 Lancaster et al.
7,419,429 B2 9/2008 Taylor
7,431,644 B2 10/2008 Moody
7,476,542 B2 1/2009 Walker et al.
7,524,243 B2 4/2009 Bansemer et al.
7,641,197 B2 1/2010 Jackson
7,658,672 B1 2/2010 Wolf et al.
7,749,059 B2 7/2010 Tarantino
7,749,061 B2 7/2010 Walker et al.
7,785,188 B2 8/2010 Cannon
7,803,041 B2 9/2010 Gold et al.
7,803,043 B2 9/2010 Jackson
7,815,500 B2 10/2010 Montross et al.
7,837,545 B2 11/2010 Blair, Jr. et al.
7,857,693 B1 12/2010 Johnson et al.
7,867,073 B2 1/2011 Walker et al.
7,914,372 B2 3/2011 Tessmer et al.
7,993,191 B2 8/2011 Evans et al.
2001/0054794 A1 12/2001 Cole et al.
2002/0049084 A1 4/2002 Hughs-Baird et al.
2002/0082069 A1 6/2002 Parker
2002/0086725 A1 7/2002 Fasbender et al.
2002/0137559 A1 9/2002 Baerlocher
2002/0155873 A1 10/2002 Berman et al.
2002/0193158 A1 12/2002 Weiss et al.
2003/0022711 A1 1/2003 Locke et al.
2003/0036419 A1 2/2003 Baerlocher et al.
2003/0036422 A1 2/2003 Baerlocher et al.
2003/0036424 A1 2/2003 Baerlocher
2003/0054873 A1 3/2003 Peterson
2003/0060266 A1 3/2003 Baerlocher
2003/0064779 A1 4/2003 Suda
2003/0071417 A1 4/2003 Webb
2003/0073476 A1 4/2003 Friedman
2003/0114218 A1 6/2003 McClintic
2003/0114219 A1 6/2003 McClintic
2003/0114220 A1 6/2003 McClintic
2003/0119573 A1 6/2003 McClintic
2003/0119576 A1 6/2003 McClintic et al.
2003/0119580 A1 6/2003 McClintic et al.
2003/0125102 A1 7/2003 Cannon
2003/0125103 A1 7/2003 Tessmer et al.
2003/0125107 A1 7/2003 Cannon
2003/0130024 A1 7/2003 Darby
2003/0153383 A1 8/2003 Baerlocher et al.
2003/0207713 A1 11/2003 Taylor
2004/0023713 A1 2/2004 Wolf et al.
2004/0033830 A1 2/2004 Gold et al.
2004/0038724 A1 2/2004 Asdale
2004/0043807 A1 3/2004 Pennington
2004/0082378 A1 4/2004 Peterson et al.
2004/0116173 A1 6/2004 Baerlocher
2004/0130023 A1 7/2004 Naiki
2004/0198482 A1* 10/2004 Millerschone ..... 463/13
2004/0242313 A1 12/2004 Munoz
2005/0009597 A1 1/2005 Daly
2005/0054429 A1 3/2005 Baerlocher et al.
2005/0060050 A1 3/2005 Baerlocher
2005/0071023 A1 3/2005 Gilliland et al.
2005/0096123 A1 5/2005 Cregan et al.
2005/0110215 A1 5/2005 Jackson
2005/0133998 A1 6/2005 Ungaro
2005/0148378 A1 7/2005 Fasbender et al.
2005/0173863 A1 8/2005 Walker et al.
2005/0202863 A1 9/2005 Macaulay
2005/0208992 A1 9/2005 Randall
2005/0282625 A1 12/2005 Nicely
2006/0025193 A1 2/2006 Gail et al.
2006/0030403 A1 2/2006 Lafky et al.
2006/0040728 A1 2/2006 Fuller
2006/0058095 A1 3/2006 Berman et al.
2006/0063580 A1 3/2006 Nguyen et al.
2006/0116189 A1 6/2006 Tessmer et al.
2006/0135238 A1 6/2006 Lancaster et al.
2006/0142077 A1 6/2006 Miles et al.
2006/0246981 A1* 11/2006 Walker et al. ..... 463/13
2007/0021182 A1 1/2007 Gauselmann
2007/0054721 A1 3/2007 Jackson
2007/0087804 A1 4/2007 Knowles et al.
2007/0135207 A1 6/2007 Tarantino
2007/0167208 A1 7/2007 Acres
2007/0287532 A1 12/2007 Jackson
2008/0020815 A1 1/2008 Lancase
2008/0064462 A1 3/2008 Gerrard et al.
2008/0070674 A1 3/2008 Lancaster et al.
2008/0076500 A1 3/2008 Lancaster et al.
2008/0076503 A1 3/2008 Mattice et al.
2008/0111309 A1 5/2008 Nicely et al.
2008/0113759 A1 5/2008 Baerlocher
2008/0119257 A1 5/2008 Stern et al.
2008/0182650 A1 7/2008 Randall et al.
2008/0188278 A1 8/2008 Paulsen et al.
2008/0214255 A1 9/2008 Jarvis et al.
2008/0214292 A1 9/2008 Bryant et al.
2008/0242389 A1 10/2008 Jackson
2008/0254847 A1 10/2008 Millerschone
2008/0318668 A1 12/2008 Ching et al.

(56) References Cited

U.S. PATENT DOCUMENTS

| | | | |
|---|---|---|---|
| 2009/0005144 | A1 | 1/2009 | Moody |
| 2009/0104962 | A1 | 4/2009 | Nicely et al. |
| 2009/0104977 | A1 | 4/2009 | Zielinski |
| 2009/0111573 | A1 | 4/2009 | Iddings |
| 2009/0117959 | A1 | 5/2009 | Nicely |
| 2009/0121434 | A1 | 5/2009 | Baerlocher et al. |
| 2009/0181743 | A1 | 7/2009 | Bansemer et al. |
| 2010/0035676 | A1 | 2/2010 | Nicely et al. |
| 2010/0120484 | A1 | 5/2010 | Caputo et al. |
| 2010/0144415 | A1 | 6/2010 | Wolf et al. |
| 2010/0227661 | A1 | 9/2010 | Walker et al. |
| 2010/0252997 | A1 | 10/2010 | Walker et al. |
| 2010/0289220 | A1 | 11/2010 | Jackson |
| 2011/0003625 | A1 | 1/2011 | Montross et al. |
| 2011/0111824 | A1 | 5/2011 | Cuddy et al. |
| 2011/0111841 | A1 | 5/2011 | Tessmer et al. |

FOREIGN PATENT DOCUMENTS

| | | |
|---|---|---|
| EP | 1 067 491 | 1/2001 |
| GB | 2 072 395 | 9/1981 |
| GB | 2 137 392 | 10/1984 |
| GB | 2 180 682 | 4/1987 |
| GB | 2 222 712 | 3/1990 |
| GB | 2 226 436 | 3/1990 |
| WO | WO 97/32285 | 9/1997 |
| WO | WO 01/19476 | 3/2001 |
| WO | WO 01/33478 | 5/2001 |
| WO | WO 2005/010831 | 2/2005 |
| WO | WO 2005/083599 | 9/2005 |
| WO | WO 2006/002241 | 1/2006 |
| WO | WO 2006/004831 | 1/2006 |
| WO | WO 2007/090270 | 8/2007 |

* cited by examiner

| Hand Ranking | 1 Credit | 2 Credits | 3 Credits | 4 Credits | 5 Credits |
|---|---|---|---|---|---|
| Royal Flush | 250 | 500 | 750 | 1000 | 4000 |
| Straight Flush | 50 | 100 | 150 | 200 | 250 |
| 4 of a Kind | 25 | 50 | 75 | 100 | 125 |
| Full House | 9 | 18 | 27 | 36 | 45 |
| Flush | 6 | 12 | 18 | 24 | 30 |
| Straight Flush | 4 | 8 | 12 | 16 | 20 |
| 3 of a Kind | 3 | 6 | 9 | 12 | 15 |
| 2 Pair | 2 | 4 | 6 | 8 | 10 |
| Jacks or Better | 1 | 2 | 3 | 4 | 5 |

| Hand Ranking | 1 Credit | 2 Credits | 3 Credits | 4 Credits | 5 Credits |
|---|---|---|---|---|---|
| Royal Flush | 250 | 500 | 750 | 1000 | 4000 |
| Straight Flush | 50 | 100 | 150 | 200 | 250 |
| 4 of a Kind | 25 | 50 | 75 | 100 | 125 |
| Full House | 9 | 18 | 27 | 36 | 45 |
| Flush | 6 | 12 | 18 | 24 | 30 |
| Straight Flush | 4 | 8 | 12 | 16 | 20 |
| 3 of a Kind | 3 | 6 | 9 | 12 | 15 |
| 2 Pair | 2 | 4 | 6 | 8 | 10 |
| Jacks or Better | 1 | 2 | 3 | 4 | 5 |

| Hand Ranking | 1 Credit | 2 Credits | 3 Credits | 4 Credits | 5 Credits |
|---|---|---|---|---|---|
| Royal Flush | 250 | 500 | 750 | 1000 | 4000 |
| Straight Flush | 50 | 100 | 150 | 200 | 250 |
| 4 of a Kind | 25 | 50 | 75 | 100 | 125 |
| Full House | 9 | 18 | 27 | 36 | 45 |
| Flush | 6 | 12 | 18 | 24 | 30 |
| Straight Flush | 4 | 8 | 12 | 16 | 20 |
| 3 of a Kind | 3 | 6 | 9 | 12 | 15 |
| 2 Pair | 2 | 4 | 6 | 8 | 10 |
| Jacks or Better | 1 | 2 | 3 | 4 | 5 |

| Hand Ranking | 1 Credit | 2 Credits | 3 Credits | 4 Credits | 5 Credits |
|---|---|---|---|---|---|
| Royal Flush | 250 | 500 | 750 | 1000 | 4000 |
| Straight Flush | 50 | 100 | 150 | 200 | 250 |
| 4 of a Kind | 25 | 50 | 75 | 100 | 125 |
| Full House | 9 | 18 | 27 | 36 | 45 |
| Flush | 6 | 12 | 18 | 24 | 30 |
| Straight Flush | 4 | 8 | 12 | 16 | 20 |
| 3 of a Kind | 3 | 6 | 9 | 12 | 15 |
| 2 Pair | 2 | 4 | 6 | 8 | 10 |
| Jacks or Better | 1 | 2 | 3 | 4 | 5 |

GAMING SYSTEM, GAMING DEVICE, AND METHOD PROVIDING A CARD GAME HAVING A DISCARDED CARD RE-INSERTION FEATURE

PRIORITY CLAIM

This application is a continuation of, and claims priority to and the benefit of, U.S. patent application Ser. No. 13/327,191, filed on Dec. 15, 2011, the entire contents of which are incorporated herein by reference.

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Poker games are very popular. One of the most common variations of poker is Five Card Draw. In general, in Five Card Draw poker a player is dealt five cards face up from a standard fifty-two card deck of playing cards. The player can discard none of, one of, a plurality of but less than all of, or all of the five cards. Each discarded card is replaced with another card from the deck. After replacement, the cards are evaluated for winning combinations. For a five card poker game, there are ten general categories of hands, ranked from highest to lowest, as shown in Table 1 below.

TABLE 1

Ranking of Five Card Poker Hands by Category

| Rank | Name | Example |
|---|---|---|
| 1 | Royal Straight Flush | A♣ K♣ Q♣ J♣ 10 ♣ |
| 2 | Straight Flush | K♣ Q♣ J♣ 10♣ 9♣ |
| 3 | Four of a Kind | J♣ J♥ J♦ J♠ 3♣ |
| 4 | Full House | A♥ A♦ A♣ 6♦ 6♣ |
| 5 | Flush | A♣ J♣ 8♣ 6♣ 2♣ |
| 6 | Straight | 8♦ 7♣ 6♠ 5♠ 4♣ |
| 7 | Three of a Kind | Q♠ Q♥ Q♦ 6♦ 2 ♠ |
| 8 | Two Pair | 8♦ 8♥ 5♥ 5♣ 2♠ |
| 9 | One Pair | K♦ K♣ 8♣ 7♣ 2♥ |
| 10 | High Card | A♥ 10♣ 7♦ 5♣ 3♠ |

Within each category, hands are ranked according to the rank of individual cards, with an ace being the highest card and a two being the lowest card. There is no difference in rank between the four suits of cards. All hands can be ranked in a linear ranking from highest to lowest. Because suits are all of the same value, however, there are multiple hands that have identical rankings. For example, there are four equivalent hands for each type of straight flush, four of a kind, or flush; there are over one hundred equivalent hands for each two pair variation; and there are over 1,000 equivalent hands for each type of no-pair hand.

Numerous other variations of poker are known, including Three Card Poker, Five Card Stud, Seven Card Stud, Hold'em (also called Texas Hold'em), Omaha (also called Omaha Hold'em), and Pai-Gow Poker. The variations in these games generally differ in the manner in which cards are dealt and in the manner and frequency in which bets are placed. Various criteria may also be used to determine a winning hand, including highest ranking hand, lowest ranking hand (Low-Bail), and the highest and lowest ranking hands (High-Low).

The number of cards dealt to a player and the player's ability to discard cards and draw replacement cards depends on the particular variation of poker being played. In typical video-based Five Card Draw Poker games, a player receives five cards from a virtual deck of cards to form an initial player hand. The player is able to either hold or discard each of the cards in the initial player hand. Typically, the player selects a hold input associated with a particular card to signify that the player would like to keep that card. Any discarded cards are replaced with cards from the virtual deck to form a final player hand. The final player hand is compared to a paytable, and the player is provided any awards based on a rank of the final player hand.

Other variations of Five Card Draw Poker exist, such as Deuces Wild. In this variation, any two in a player's hand functions as a wild card. In typical Three Card Poker games, a player plays the player's hand against a dealer hand and the player and dealer hands each include a total of three cards. In certain known Three Card Poker games, the initially dealt player hand and dealer hand are final and there is no option to replace or draw any new cards. In stud poker games, such as Five Card Stud and Seven Card stud, each player receives a number of cards dealt face-down and a number of cards dealt face-up. In typical stud games, the player is not allowed to draw or replace cards in the player hand.

Certain players seek out variations of traditional card games such as Five Card Draw, Three Card Poker, Five Card Stud, Seven Card Stud, Hold'em, Omaha, and Pai-Gow Poker. Thus, a continuing need exists for new, entertaining, and exciting card games with high degrees of player interaction.

SUMMARY

Various embodiments of the present disclosure provide a gaming system, gaming device, and method providing a card game having a discarded card re-insertion feature. In general, upon receiving a primary wager from a player, the gaming system provides a play of a card game (such as a draw poker game) in which the gaming system enables the player to select one or more cards in a player's hand to discard and in which, if the gaming system discards any of the cards in the player's hand, the gaming system replaces at least one of the discarded cards with a replacement card. The gaming system enables the player to place an optional secondary wager to cause the gaming system to activate the discarded card re-insertion feature. If the discarded card re-insertion feature is active, and if the gaming system discarded any of the cards in the player's hand, the gaming system enables the player to cause zero or at least one of the discarded cards to be re-inserted into the player's hand.

More specifically, in certain embodiments, the gaming system enables a player to place a primary wager and an optional secondary wager for a play of a card game. After receiving the primary wager, the gaming system randomly selects a first plurality of cards from a set of a plurality of cards to form a player's first hand, and displays the player's first hand. The gaming system enables the player to select zero, one, or a plurality of the cards in the player's first hand to discard and replace. If the gaming system receives a selection of zero of the cards in the player's first hand to discard and replace, the gaming system determines and provides any awards associated with the player's first hand.

If the gaming system receives a selection of one or more of the cards in the player's first hand to discard and replace, for each selected card, the gaming system: (a) discards the selected card, and (b) replaces that discarded card with a replacement card from the cards remaining in the set of cards to form a player's second hand. The gaming system displays the player's second hand. If the gaming system does not receive the secondary wager, the gaming system determines and provides any awards associated with the player's second hand.

If the gaming system receives the secondary wager, the gaming system activates the discarded card re-insertion feature. That is, the gaming system enables the player to select zero or at least one of the replacement cards in the player's second hand to replace with at least one of the discarded cards (i.e., enables the player to cause the gaming system to re-insert at least one of the discarded cards back into the player's hand). If the gaming system receives a selection of zero of the replacement cards in the player's second hand to replace with at least one of the discarded cards, the gaming system determines and provides any awards associated with the player's second hand. If the gaming system receives a selection of at least one of the replacement cards to replace with at least one of the discarded cards, the gaming system replaces at least one of the selected replacement cards with one of the discarded cards to form a player's third hand, displays the player's third hand and determines and provides any awards associated with the player's third hand.

In various embodiments, the gaming system enables the player to place the secondary wager before randomly selecting and displaying the player's first hand. In certain embodiments, the gaming system enables the player to place the secondary wager after randomly selecting and displaying the player's first hand and before replacing any discarded cards with replacement cards. In other embodiments, the gaming system enables the player to place the secondary wager after replacing any discarded cards with replacement cards and after displaying the player's second hand.

In certain embodiments, if the gaming system receives the secondary wager, the gaming system enables the player to select zero, one, or a plurality of any replacement cards in the player's second hand to replace with at least one of any discarded cards. In various other embodiments, if the gaming system receives the secondary wager, the gaming system enables the player to select zero or one of any replacement cards in the player's second hand to replace with one of any discarded cards. That is, in these embodiments, the gaming system does not enable the player to select more than one of any replacement cards in the player's second hand to replace with one of any discarded cards.

In other embodiments, if the gaming system receives the secondary wager, the gaming system enables the player to select zero up to a designated quantity of any replacement cards in the player's second hand to replace with at least one of any discarded cards. In certain of these embodiments, the designated quantity is determined by an amount of the secondary wager. In embodiments in which the gaming system enables the player to place the secondary wager after displaying the player's second hand, this enables the player to choose exactly how many of any discarded cards to re-insert into the player's hand. In embodiments in which the gaming system enables the player to place the secondary wager before displaying the player's first hand, this enables the player to choose exactly how many of any cards which may be discarded in the future that the gaming system will enable the player to re-insert into the player's hand.

In certain embodiments in which the gaming system received the secondary wager and discarded and replaced at least one card in the player's first hand, when the gaming system receives a selection of one of the replacement cards to replace with one of the discarded cards, the gaming system replaces that selected replacement card with the discarded card that that selected replacement card replaced.

In various embodiments, the gaming system determines any awards for any plays of the card game based on the received primary wager and not based on any received secondary wager. It should thus be appreciated that, in these embodiments, placement of the secondary wager does not increase any payouts or otherwise change the paytable of the card game relative to the payouts and the paytable of the card game when the secondary wager is not placed.

Additional features and advantages are described herein, and will be apparent from, the following Detailed Description and the Figures.

BRIEF DESCRIPTION OF THE FIGURES

FIGS. 1A and 16 are perspective views of example alternative embodiments of a gaming device of the gaming system of the present disclosure.

DETAILED DESCRIPTION

Gaming Device and Electronics

The present disclosure may be implemented in various configurations for gaming machines, gaming devices, or gaming systems, including but not limited to: (1) a dedicated gaming machine, gaming device, or gaming system wherein the computerized instructions for controlling any games (that are provided by the gaming machine or gaming device) are provided with the gaming machine or gaming device prior to delivery to a gaming establishment; and (2) a changeable gaming machine, gaming device, or gaming system wherein the computerized instructions for controlling any games (that are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games for other suitable interfaces), and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling the base or primary game of the present disclosure are communicated from the central server to the gaming device in a thick client configuration and computerized instructions for controlling any secondary or bonus games or functions are executed by a central server in a thin client configuration.

Figure 1A:
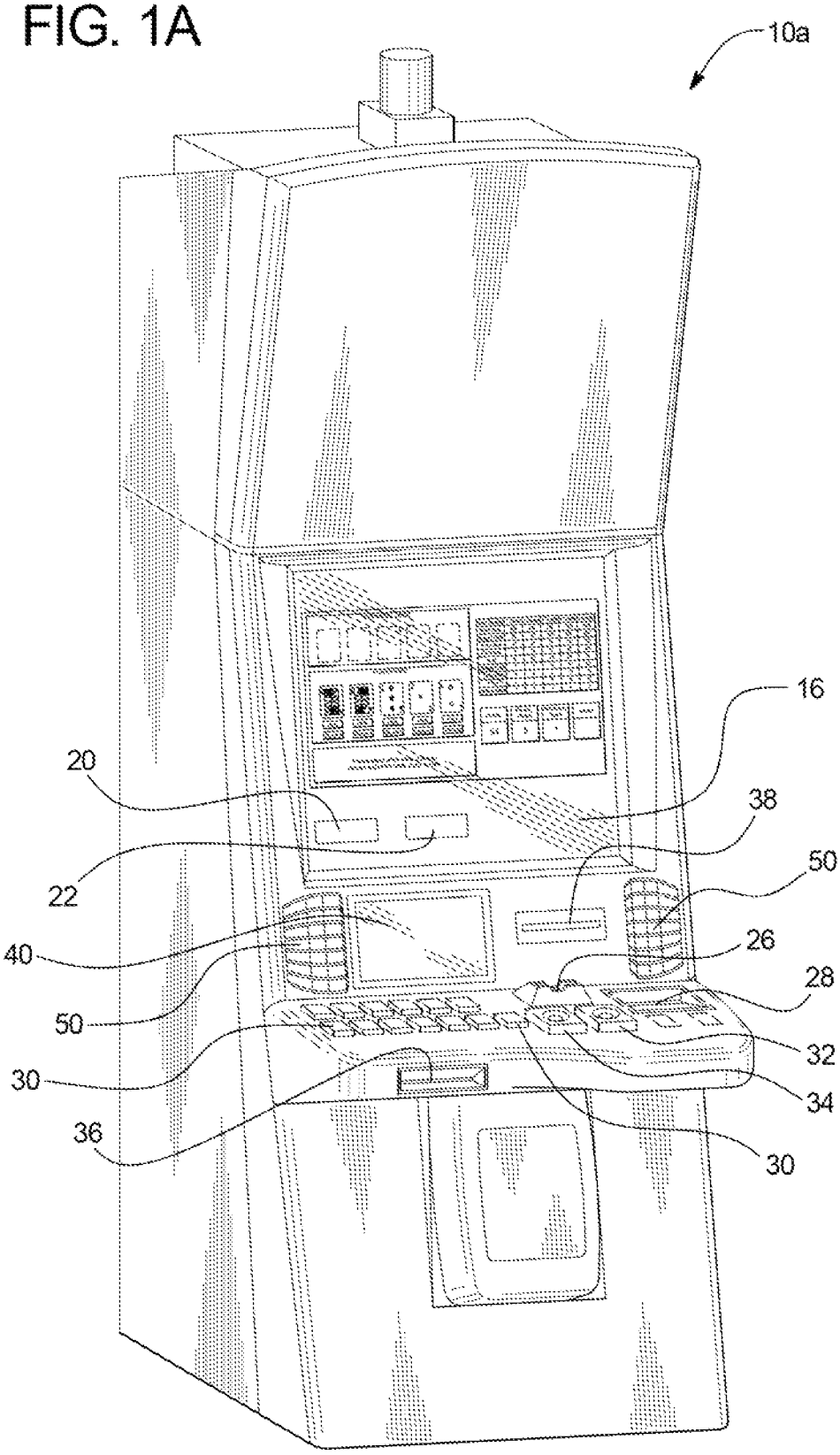
Figure 1B:
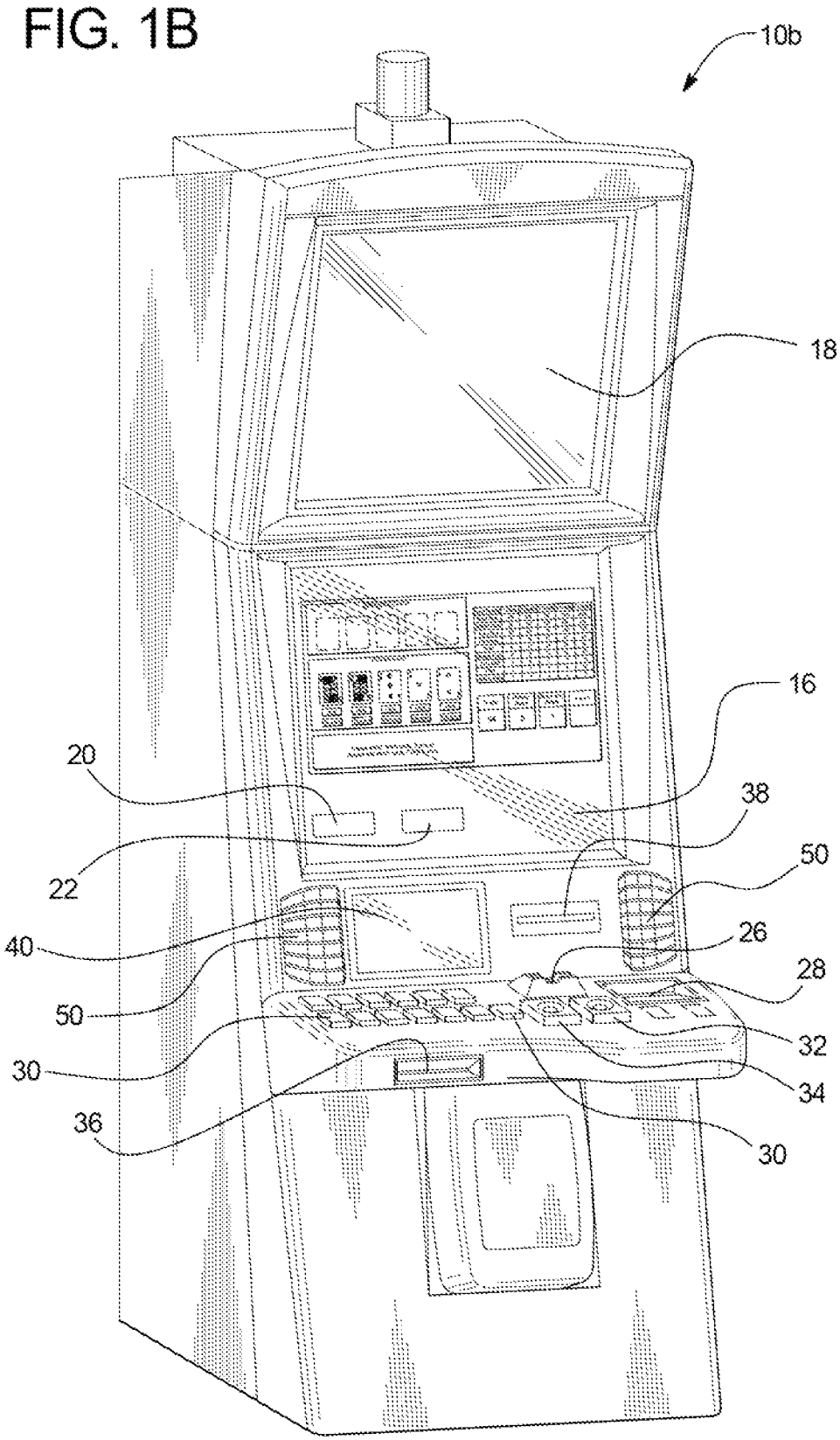

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet that provides support for a plurality of displays, inputs, controls, and other features of a conventional gaming machine. It is configured so that a player may operate it while standing or sitting. The gaming device may be positioned on a base or stand or may be configured as a pub-style table-top game (not shown) that a player may operate preferably while sitting. As illustrated by the different configurations shown in FIGS. 1A and 1B, the gaming device may have varying cabinet and display configurations.

Figure 2A:
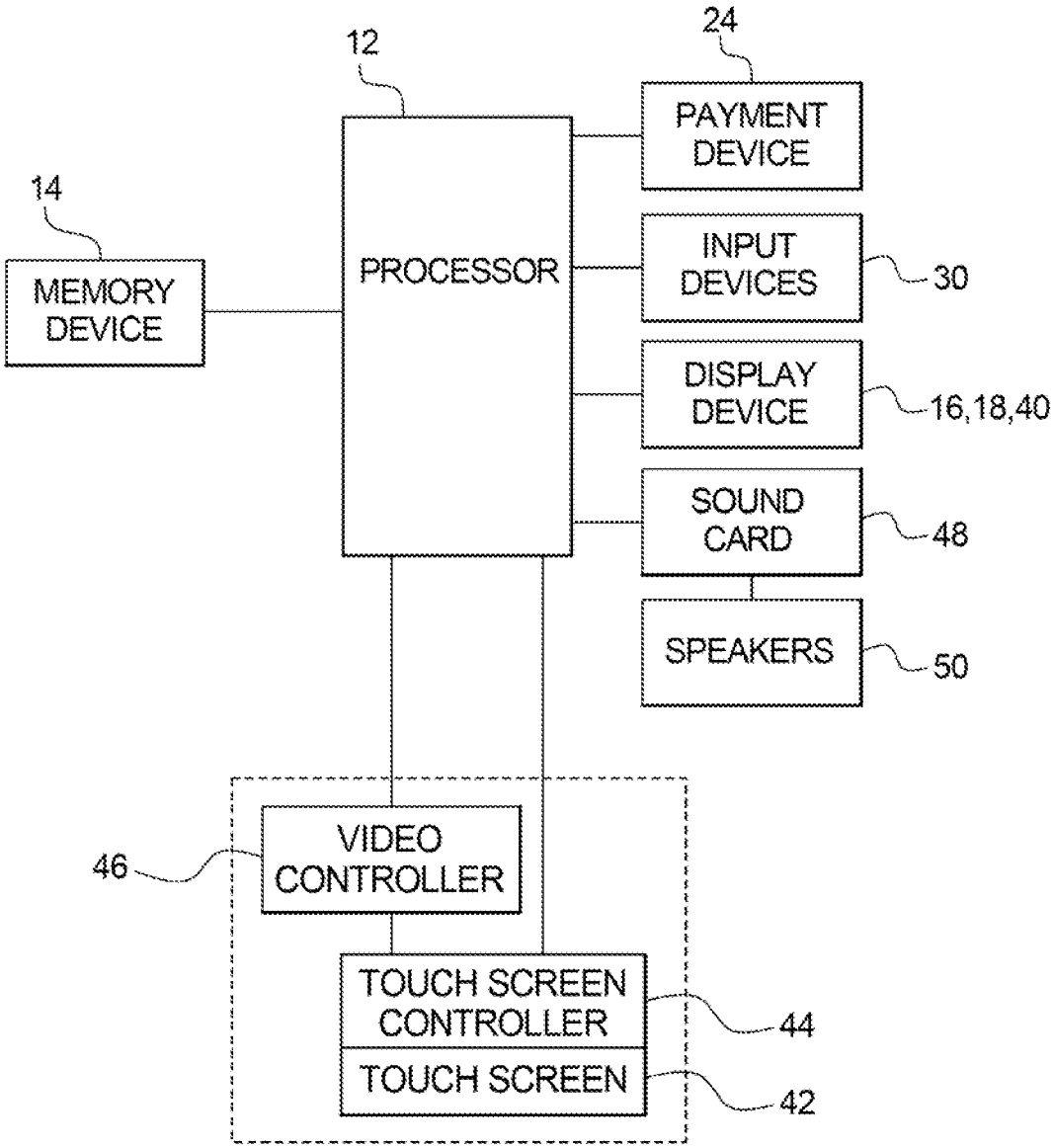
FIG. 2A is a schematic block diagram of one embodiment of an electronic configuration for one of the gaming devices of the gaming system disclosed herein.

In one embodiment, as illustrated in FIG. 2A, the gaming device includes at least one processor 12, such as a microprocessor, a microcontroller-based platform, a suitable integrated circuit, or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which may include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above may be stored in a detachable or removable memory device, such as, but not limited to, a suitable cartridge, disk, CD ROM, DVD, non-transitory computer readable medium, or USB memory device. In other embodiments, part or all of the program code and/or operating data described above may be downloaded to the memory device through a suitable network.

In one embodiment, an operator or a player may use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, such as part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 that displays any suitable base or primary game. This display device may also display any suitable secondary or bonus game associated with the base or primary game as well as information relating to the base or primary game or the secondary or bonus game. The alternative embodiment shown in FIG. 1B includes a central display device 16 and an upper display device 18. The upper display device may display the base or primary game, any suitable secondary or bonus game associated or not associated with the base or primary game, and/or information relating to the base or primary game or the secondary or bonus game. These display devices may also serve as digital glass operable to advertise games or other aspects of the gaming establishment. As shown in FIGS. 1A and 1B, in one embodiment, the gaming device includes a credit display 20 that displays a player's current number of credits, cash, account balance, or the equivalent. In one embodiment, the gaming device includes a bet display 22 that displays a player's amount wagered. In one embodiment, as discussed in more detail below, the gaming device includes a player tracking display 40 that displays information regarding a player's play tracking status.

In another embodiment, at least one display device may be a mobile display device, such as a PDA or tablet PC, that enables play of at least a portion of the base or primary game or the secondary or bonus game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as discussed in more detail below, the display device includes a touch-screen with an associated touch-screen controller. The display devices may be of any suitable size and configuration, such as a square, a rectangle, or an elongated rectangle.

The display devices of the gaming device are configured to display at least one and preferably a plurality of game or other suitable images, symbols, and indicia such as any visual representation or exhibition of the movement of objects such as mechanical, virtual, or video reels and wheels; dynamic lighting; video images; images of people, characters, places, things, or faces of cards; and the like.

In one alternative embodiment, the symbols, images, and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As shown in FIGS. 1A and 1B, a payment device such as a payment acceptor includes a note, ticket, or bill acceptor 28, into which the player inserts paper money, a ticket, or voucher and a coin slot 26 into which the player inserts money, coins, or tokens. In other embodiments, payment devices such as readers or validators for credit cards, debit cards, or credit slips may accept payment. In one embodiment, a player may insert an identification card into a card reader of the gaming device. In one embodiment, the identification card is a smart card having a programmed microchip, a coded magnetic strip, or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, that communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as discussed above.

As shown in FIGS. 1A, 1B, and 2A, in one embodiment the gaming device includes at least one and preferably a plurality of input devices 30 in communication with the processor. The input devices may include any suitable device that enables the player to produce an input signal that is received by the processor. In one embodiment, after appropriate funding of the gaming device, the input device is a game activation device, such as a play button 32 or a pull arm (not shown) that is used by the player to start the base or primary game or sequence of events in the gaming device. The play button may be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player may increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) that enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as shown in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player may make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as shown in FIG. 2A, the gaming device includes a sound generating device controlled by one or more sound cards 48 that function in conjunction with the processor. In one embodiment, the sound generating device includes at least one and preferably a plurality of speakers 50 or other sound generating hardware and/or software for generating sounds, such as by playing music for the base or primary game and/or the secondary or bonus game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera and to display the visible manifestation of the game in split screen or picture-in-picture fashion. For example, the camera may acquire an image of the player and the processor may incorporate that image into the base or primary game and/or the secondary or bonus game as a game image, symbol, or indicia.

Gaming device 10 incorporates the base or primary game and any secondary or bonus game associated with the base or primary game. The gaming machine or device may include some or all of the features of conventional gaming machines or devices. The gaming device may incorporate any card game as the primary game, and any suitable spinning reel-type game, card game, cascading or falling symbol game, number game, or other game of chance susceptible to representation in an electronic or electromechanical form as the secondary or bonus game or feature.

In one embodiment, base or primary game or the secondary or bonus game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table that utilizes conventional poker hand rankings to determine the winning hands. The gaming device provides the player with an award based on a winning hand and the number of credits the player wagered.

In another embodiment, the base or primary game or the secondary or bonus game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, as noted above, in addition to winning credits or other awards in the base or primary game, the gaming device may also give players the opportunity to win credits in a secondary or bonus game or in a secondary or bonus round. The secondary or bonus game enables the player to obtain a prize or payout in addition to the prize or payout, if any, obtained from the base or primary game. In general, a secondary or bonus game produces a significantly higher level of player excitement than the base or primary game because it provides a greater expectation of winning than the base or primary game, and is accompanied with more attractive or unusual features than the base or primary game. In one embodiment, the secondary or bonus game may be any type of suitable game either similar to or completely different from the base or primary game.

In one embodiment, the triggering event or qualifying condition may be a selected outcome in the base or primary game or a particular arrangement of one or more indicia on a display device in the base or primary game, such as a joker card appearing in a player's hand during play of a primary video poker game. In other embodiments, the triggering event or qualifying condition occurs based on exceeding a certain amount of game play (such as number of games, number of credits, amount of time), or reaching a specified number of points earned during game play.

In another embodiment, gaming device processor 12 or central controller 56 randomly provides the player one or more plays of one or more secondary or bonus games. In one such embodiment, the gaming device does not provide any apparent reason to the player for qualifying to play a secondary or bonus game. In this embodiment, qualifying for a secondary or bonus game is not triggered by an event in or based specifically on any of the plays of the base or primary game. That is, the gaming device may simply qualify a player to play a secondary or bonus game without any explanation or alternatively with simple explanations. In another embodiment, the gaming device (or central server) qualifies a player for a secondary or bonus game at least partially based on a game triggered or symbol triggered event, such as at least partially based on the play of the base or primary game.

In one embodiment, the gaming device includes a program that will automatically begin a secondary or bonus round after the player has achieved a triggering event or qualifying condition in the base or primary game. In another embodiment, after a player has qualified for a secondary or bonus game, the player may subsequently enhance the player's secondary or bonus game participation through continued play of the base or primary game. Thus, for each secondary or bonus qualifying event, such as a bonus symbol, that the player obtains, a given number of secondary or bonus game wagering points or credits may be accumulated in a "bonus meter" programmed to accrue the secondary or bonus wagering credits or entries toward eventual participation in a secondary or bonus game. The occurrence of multiple such secondary or bonus qualifying events in the base or primary game may result in an arithmetic or exponential increase in the number of secondary or bonus wagering credits awarded. In one embodiment, the player may redeem extra secondary or bonus wagering credits during the secondary or bonus game to extend play of the secondary or bonus game.

In one embodiment, no separate entry fee or buy-in for a secondary or bonus game is needed. That is, a player may not purchase entry into a secondary or bonus game; rather, the player must win or earn entry through play of the base or primary game, thus encouraging play of the base or primary game. In another embodiment, qualification of the secondary or bonus game is accomplished through a simple "buy-in" by the player—for example, if the player has been unsuccessful at qualifying through other specified activities. In another embodiment, the player must make a separate side-wager on the secondary or bonus game or wager a designated amount in the base or primary game to qualify for the secondary or bonus game. In this embodiment, the secondary or bonus game triggering event must occur and the side-wager (or designated base or primary game wager amount) must have been placed to trigger the secondary or bonus game.

Figure 2B:
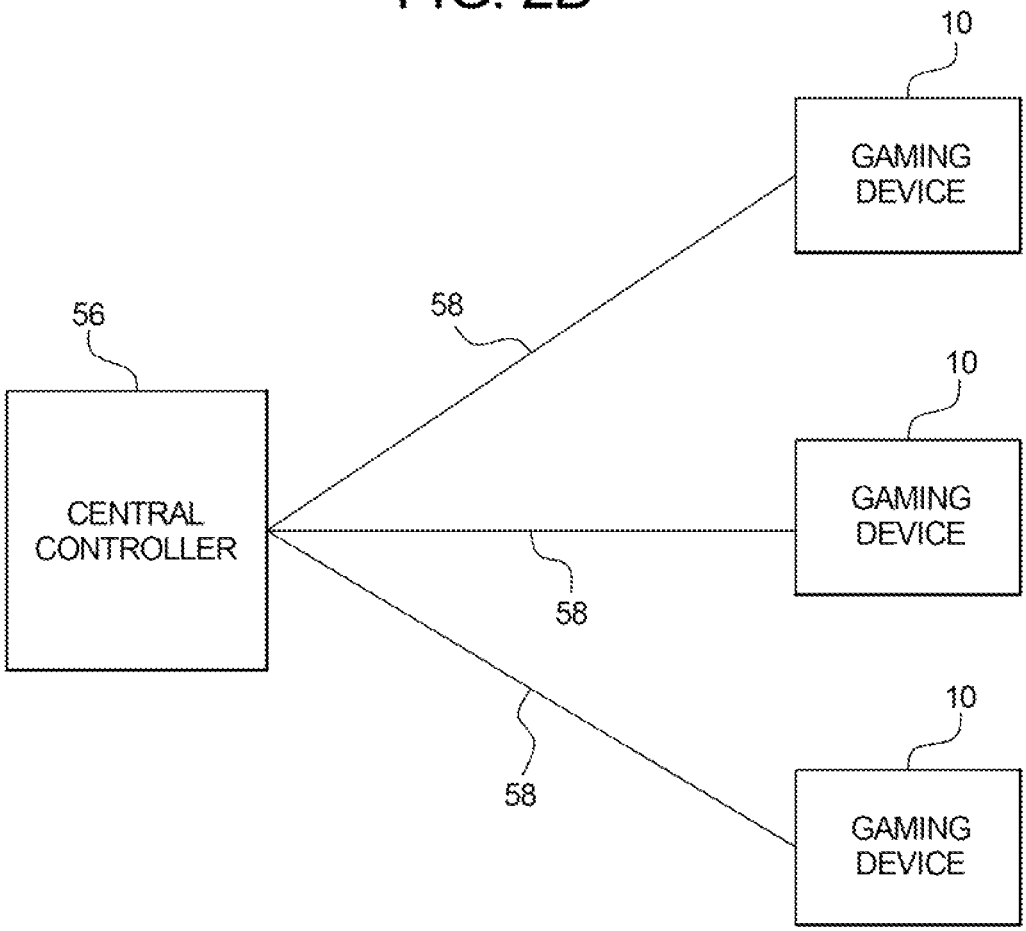
FIG. 2B is a schematic block diagram of one embodiment of a network configuration for a plurality of gaming devices of the gaming system disclosed herein.

In one embodiment, as illustrated in FIG. 2B, one or more of gaming devices 10 are in communication with each other and/or at least one central controller 56 through a data network or remote communication link 58. In this embodiment, the central server, central controller, or remote host is any suitable server or computing device that includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more, or each of the functions of the central controller, central server, or remote host as disclosed herein may be performed by one or more gaming device processors. It should be further appreciated that one, more, or each of the functions of one or more gaming device processors as disclosed herein may be performed by the central controller, central server, or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the base or primary game based on probability data. In another embodiment, the central server or controller randomly generates a game outcome for the secondary or bonus game based on probability data. In another embodiment, the central server or controller randomly generates a game outcome for both the base or primary game and the secondary or bonus game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome may include a base or primary game outcome, a secondary or bonus game outcome, base or primary game and secondary or bonus game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control may assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno, or lottery game is not displayed to the player, but the results of the bingo, keno, or lottery game determine the predetermined game outcome value for the base or primary game or the secondary or bonus game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination may be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As discussed above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10, which will be provided to a first player regardless of how the first player plays in a first stage, and a second gaming device to have selected elements marked in a different predetermined pattern is provided a second outcome of win $2, which will be provided to a second player regardless of how the second player plays a second stage. It should be appreciated that as the process of marking selected elements continues until one or more predetermined patterns are marked, this embodiment ensures that at least one bingo card will win the bingo game, and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as discussed above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as discussed above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card that has an encoded player identification number that uniquely identifies the player. When a player inserts the player's playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes the player's player tracking card when concluding play for that gaming session. In another embodiment, rather than requiring a player to insert a player tracking card, the gaming device utilizes one or more portable devices carried by a player, such as a cell phone, a radio frequency identification tag, or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) that are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device may be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as discussed above, one or more gaming devices are in communication with a central server or controller. The central server or controller may be any suitable server or computing device that includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game that may be played on one or more of the gaming devices in the gaming system. Such different games may include the same or substantially the same game play with different pay tables. In different embodiments, the executable game program is for the base or primary game, a secondary or bonus game, or both. In another embodiment, the game program may be executable as a secondary or bonus game to be played simultaneous with the play of the base or primary game (that may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate the base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of the base or primary game. That is, a player is provided a progressive award without any explanation or, alternatively, with simple explanations. In another embodiment, a player is provided a progressive award at least partially based on a game triggered or symbol triggered event, such as at least partially based on the play of the base or primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager any credit amount during the base or primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the base or primary game of the gaming machines in the gaming system, via a gaming establishment or via any suitable manner.

In another embodiment, one or more of the progressive awards are partially funded via a side-bet or side-wager that the player may make (and that may be tracked via a side-bet meter). In one embodiment, one or more of the progressive awards are funded with only side-bets or side-wagers placed. In another embodiment, one or more of the progressive awards are funded based on players' wagers as discussed above as well as any side-bets or side-wagers placed.

In one alternative embodiment, a minimum wager level is required for a gaming device to qualify to be selected to obtain one of the progressive awards. In one embodiment, this minimum wager level is the maximum wager level for the base or primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, among the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Card Game Having a Discarded Card Re-Insertion Feature

Various embodiments of the present disclosure provide a gaming system, gaming device, and method providing a card game having a discarded card re-insertion feature. In general, upon receiving a primary wager from a player, the gaming system provides a play of a card game (such as a draw poker game) in which the gaming system enables the player to select one or more cards in a player's hand to discard and in which, if the gaming system discards any of the cards in the player's hand, the gaming system replaces at least one of the discarded cards with a replacement card. The gaming system enables the player to place an optional secondary wager to cause the gaming system to activate the discarded card re-insertion feature. If the discarded card re-insertion feature is active, and if the gaming system discarded any of the cards in the player's hand, the gaming system enables the player to cause zero or at least one of the discarded cards to be re-inserted into the player's hand.

More specifically, in certain embodiments, the gaming system enables a player to place a primary wager and an optional secondary wager for a play of a card game. After receiving the primary wager, the gaming system randomly selects a first plurality of cards from a set of a plurality of cards to form a player's first hand, and displays the player's first hand. The gaming system enables the player to select zero, one, or a plurality of the cards in the player's first hand to discard and replace. If the gaming system receives a selection of zero of the cards in the player's first hand to discard and replace, the gaming system determines and provides any awards associated with the player's first hand.

If the gaming system receives a selection of one or more of the cards in the player's first hand to discard and replace, for each selected card, the gaming system: (a) discards the selected card, and (b) replaces that discarded card with a replacement card from the cards remaining in the set of cards to form a player's second hand. The gaming system displays the player's second hand. If the gaming system does not receive the secondary wager, the gaming system determines and provides any awards associated with the player's second hand.

If the gaming system receives the secondary wager, the gaming system activates the discarded card re-insertion feature. That is, the gaming system enables the player to select zero or at least one of the replacement cards in the player's second hand to replace with at least one of the discarded cards (i.e., enables the player to cause the gaming system to re-insert at least one of the discarded cards back into the player's hand). If the gaming system receives a selection of zero of the replacement cards in the player's second hand to replace with at least one of the discarded cards, the gaming system determines and provides any awards associated with the player's second hand. If the gaming system receives a selection of at least one of the replacement cards to replace with at least one of the discarded cards, the gaming system replaces at least one of the selected replacement cards with one of the discarded cards to form a player's third hand, displays the player's third hand and determines and provides any awards associated with the player's third hand.

It should be appreciated that the card game may be any suitable card game in which a player selects one or more cards in a player's hand to discard, and in which at least one of any discarded cards is replaced with a replacement card. For example, in various embodiments, the card game is (but is not limited to), draw poker, video draw poker, multi-hand draw poker, and video multi-hand draw poker.

It should also be appreciated that, in various embodiments: (a) the set of cards may include any suitable quantity of any suitable type of cards (such as a standard deck of fifty-two playing cards); (b) the player's first hand, the player's second hand, and the player's third hand each includes any suitable quantity of cards (such as two, three, five, or seven cards); (c) the quantity of cards in the player's first hand that the gaming system enables the player to discard is any suitable quantity of cards and is predetermined or determined in any suitable manner; and (d) an amount of the secondary wager is any suitable amount and is predetermined or determined in any suitable manner.

In various embodiments, the gaming system enables the player to place the secondary wager before randomly selecting and displaying the player's first hand. It should thus be appreciated that, in these embodiments, the gaming system enables the player to place the secondary wager before the player views the player's first hand. In certain embodiments, the gaming system enables the player to place the secondary wager after randomly selecting and displaying the player's first hand and before replacing any discarded cards with replacement cards. It should thus be appreciated that, in these embodiments, the gaming system enables the player to place the secondary wager after the player views the player's first hand and before the player views the player's second hand. In other embodiments, the gaming system enables the player to place the secondary wager after replacing any discarded cards with replacement cards and after displaying the player's second hand. It should be appreciated that, in these embodiments, the gaming system enables the player to place the secondary wager after the player views the player's second hand. It should be appreciated that the gaming system may enable the player to place the secondary wager at any other suitable time.

In certain embodiments, if the gaming system receives the secondary wager, the gaming system enables the player to select zero, one, or a plurality of any replacement cards in the player's second hand to replace with at least one of any discarded cards. In various other embodiments, if the gaming system receives the secondary wager, the gaming system enables the player to select zero or one of any replacement cards in the player's second hand to replace with one of any discarded cards. That is, in these embodiments, the gaming system does not enable the player to select more than one of any replacement cards in the player's second hand to replace with one of any discarded cards.

In other embodiments, if the gaming system receives the secondary wager, the gaming system enables the player to select zero up to a designated quantity of any replacement cards in the player's second hand to replace with at least one of any discarded cards. In certain of these embodiments, the designated quantity is determined by an amount of the secondary wager. That is, in these embodiments, the designated quantity is one of a plurality of designated quantities determined based on the amount of the secondary wager. In embodiments in which the gaming system enables the player to place the secondary wager after displaying the player's second hand, this enables the player to choose exactly how many of any discarded cards to re-insert into the player's hand. In embodiments in which the gaming system enables the player to place the secondary wager before displaying the player's first hand, this enables the player to choose exactly how many of any cards which may be discarded in the future that the gaming system will enable the player to re-insert into the player's hand.

For example, in one of these embodiments in which the gaming system enables the player to place the secondary wager after displaying the player's second hand, the gaming system enables the player to place a secondary wager having: (a) a first amount (such as 1 credit), (b) a second amount (such, as 2 credits), (c) a third amount (such as three credits), or (d) a fourth amount (such as 4 credits). If the gaming system does not receive a secondary wager, the gaming system does not enable the player to select any replacement cards to replace with at least one of any discarded cards. If the gaming system receives the secondary wager of: (a) the first amount, the gaming system enables the player to select zero or one of any replacement cards to replace with one of any discarded cards; (b) the second amount, the gaming system enables the player to select zero, one, or two of any replacement cards to replace with at least one of any discarded cards; (c) the third amount, the gaming system enables the player to select zero, one, two, or three of any replacement cards to replace with at least one of any discarded cards; and (d) the fourth amount, the gaming system enables the player to select zero, one, two, three, or four of any replacement cards to replace with at least one of any discarded cards. Thus, in this example, assuming that two cards in the player's first hand were discarded, the gaming system enables the player to place: no secondary wager if the player desires to replace zero of the replacement cards, the secondary wager having the first amount if the player desires to replace one of the replacement cards, and the secondary wager having the second amount if the player desires to replace two of the replacement cards.

It should be appreciated that the designated quantity may be determined in any suitable manner. For example, in various embodiments, the designated quantity is: (a) predetermined, (b) randomly determined, (c) determined based on the player's status (such as through a player tracking system), (d) determined based on a weighted probability table, (e) determined by the player, and (f) any suitable combination thereof.

In certain embodiments in which the player placed the secondary wager and at least one card was discarded and replaced, when the gaming system receives a selection of one of the replacement cards to replace with one of the discarded cards, the gaming system replaces that selected replacement card with the discarded card that that selected replacement card replaced. That is, in these embodiments, each discarded card can only replace (i.e., be re-inserted in place of) its corresponding replacement card. In other embodiments, when the gaming system receives a selection of one of the replacement cards to replace with one of the discarded cards, the gaming system replaces that selected replacement card with a randomly determined one of any discarded cards (assuming that more than one card was discarded). In various embodiments, when the gaming system receives a selection of one of the replacement cards to replace with one of the discarded cards, the gaming system replaces that selected replacement card with one of any discarded cards that that replacement card did not replace (assuming that more than one card was discarded). It should be appreciated that when the gaming system receives a selection of one of the replacement cards to replace with one of the discarded cards, the gaming system replaces that replacement card with any suitable one of any discarded cards.

In various embodiments, the gaming system enables the player to place the secondary wager both: (a) before randomly generating and displaying the player's first hand, and (b) after displaying the player's second hand. In certain of these embodiments, an amount of the secondary wager is greater if the gaming system receives the secondary wager after displaying the player's second hand than if the gaming system receives the secondary wager before randomly generating and displaying the player's first hand. In other words, in these embodiments it costs more for the player to activate the discarded card re-insertion feature after receiving any replacement cards than it does for the player to activate the discarded card re-insertion feature before viewing the player's first hand.

In various embodiments, the card game is a multi-hand card game, such as a multi-hand draw poker game. In certain of these embodiments in which the discarded card re-insertion feature is active, the gaming system enables the player to replace any replacement cards in a given hand with cards discarded from that hand. That is, in these embodiments, the gaming system does not enable the player to re-insert discarded cards that were discarded from one hand into a different hand (from which the discarded cards were not discarded). In other of these embodiments in which the discarded card re-insertion feature is active, the gaming system enables the player to replace any replacement cards in a given hand with cards discarded from other hands. That is, in these embodiments, the gaming system enables the player to re-insert discarded cards that were discarded from one hand into a different hand (from which the discarded cards were not discarded).

In certain embodiments, when the player places the secondary wager, the gaming system activates the discarded card re-insertion feature for a plurality of future plays of the card game. That is, the player may "purchase" the discarded card re-insertion feature for a plurality of plays of the card game by placing a single secondary wager or paying a single designated fee.

In other embodiments, the gaming system enables a player to activate the discarded card re-insertion feature by paying or wagering a designated quantity of player tracking points associated with the player's player tracking account. In certain of these embodiments, the player only wagers player tracking points and does not wager any credits to activate the discarded card re-insertion feature. In other embodiments, the player wagers or pays player tracking points to offset the cost of the secondary wager. For example, the player wagers or pays a designated quantity of player tracking points to reduce an amount of the secondary wager by 50% (or any other suitable percentage). In certain embodiments, the designated quantity of player tracking points a player must wager or pay to activate the discarded card re-insertion feature is based on the player's player tracking ranking or status. For example, in one embodiment, players of the lowest player tracking rank (such as a Bronze rank) must pay or wager a relatively high quantity of player tracking points to activate the discarded card re-insertion feature, while players of the highest player tracking rank (such as a Platinum rank) must pay or wager a relatively low quantity of player tracking points to activate the discarded card re-insertion feature.

In various embodiments, the gaming system determines any awards for any plays of the card game based on the received primary wager and not based on any received secondary wager. It should thus be appreciated that, in these embodiments, placement of the secondary wager does not increase any payouts or otherwise change the paytable of the card game relative to the payouts and the paytable of the card game when the secondary wager is not placed. In certain other embodiments, the gaming system determines any awards for any plays of the card game based on the received primary wager and any received secondary wager.

In certain embodiments, the gaming system enables the player to select zero or at least one of any of the cards in the player's second hand to replace with at least one of any discarded cards. That is, in these embodiments, the player is not limited to replacing one or more of the replacement cards with one or more of the discarded cards. Rather, in these embodiments the player may choose to replace at least one of any of the cards in the player's second hand with at least one of any discarded cards. In other embodiments, the gaming system enables the player to select zero or at least one of any non-replacement cards in the player's second hand to replace with at least one of any discarded cards. That is, in these embodiments, the player may not replace any replacement cards with any discarded cards. Rather, in these embodiments the player may only replace any non-replacement cards with at least one of any discarded cards.

In various embodiments, the gaming system enables the player to select exactly which of any replacement cards to replace with at least one of any discarded cards. In other embodiments, the gaming system enables the player to select a quantity of any replacement cards to replace with at least one of any discarded cards, and the gaming system determines exactly which of any replacement cards to replace with at least one of any discarded cards. Exactly which cards the gaming system determines is: (a) predetermined, (b) randomly determined, (c) determined based on the player's status (such as through a player tracking system), (d) determined based on a weighted probability table, (e) any suitable combination thereof, or (f) determined in any suitable manner.

While the above embodiments describe the card game having the discarded card re-insertion feature as being implemented by a video gaming system or gaming device, it should be appreciated that in various embodiments the card game having the discarded card re-insertion feature is implemented as a table game operated by a dealer. For example, in one embodiment, the card game having the discarded card re-insertion feature is implemented at a physical gaming table employing electronic cards and an electronic dealer. In another embodiment, the card game having the discarded card re-insertion feature is implemented at a physical gaming table employing physical cards and a human dealer.

FIGS. 3A, 3B, 3C, 3D, 3E, 3F, and 3G illustrate screen shots of an example of one embodiment of the gaming system and gaming device of the present disclosure (referred to herein as the "gaming system") configured to operate a card game. In this embodiment: (a) the card game is a single hand video draw poker game; (b) the set of cards is a standard set of fifty-two playing cards; (c) the gaming system enables a player to place a secondary wager (thereby activating the discarded card re-insertion feature for the play of the card game) before randomly selecting and displaying a player's first hand; (d) the secondary wager placed by the player is of a predetermined amount; (e) if the player places the secondary wager, the gaming system enables the player to select zero, one, or a plurality of any replacement cards to replace with at least one of any discarded cards; and (f) if the player places the secondary wager and selects one or more of any replacement cards, for each selected replacement card, the gaming system replaces that selected replacement card with the discarded card that that selected replacement card replaced.

In this example embodiment, a display device 120 displays a player hand display area 130 and a discarded card display section 140. Player hand display area 130 includes player card display areas 130*a*, 130*b*, 130*c*, 130*d*, and 130*e*. Each of the player card display areas is configured to display one card of the set of cards (i.e., one of the standard set of fifty-two playing cards in this example). Discarded card display area 140 includes discarded card display areas 140*a*, 140*b*, 140*c*, 140*d*, and 140*e*. Each of the discarded card display areas is configured to display one card of the set of cards (i.e., one of the standard set of fifty-two playing cards in this example).

Display device 120 displays a paytable 129 employed by the gaming system for the card game. The paytable includes a plurality of winning hands (in this embodiment, Royal Flush, Straight Flush, 4 of a Kind, Full House, Flush, Straight Flush, 3 of a Kind, 2 Pair, Jacks or Better) and the credit payout associated with each winning hand when a designated wager (in this embodiment, 1 credit, 2 credits, 3 credits, 4 credits, or 5 credits) is placed. It should be appreciated that, in this example embodiment, any credit payouts are calculated based on the primary wager placed by the player and not based on the secondary wager (if any) placed by the player. For example, in this embodiment, if a player places a primary wager of 3 credits and the secondary wager of 1 credit, the gaming system employs the portion of paytable 129 associated with a 3 credit wager (and not the portion of paytable 129 associated with a 4 credit wager).

Display device 120 also displays an indication, notification, or message display area 121, which displays information, notifications, and/or messages before, during, or after play of the card game; a credit meter 122, which indicates the player's credit balance; a primary wager indicator or display 124, which indicates an amount of any primary wager placed by the player for a play of the card game; a secondary wager indicator or display 126, which indicates an amount of any secondary wager placed by the player for a play of the card game, and an award indicator or display 128, which indicates an amount of any award or awards a player has won for a play of the card game.

It should be appreciated that, in various embodiments: (a) the display device may display any suitable quantity of player card display areas or discarded card display areas in any suitable configuration or arrangement; (b) any suitable paytable including any suitable quantity of winning hands may be used for the card game; (c) any suitable combinations of the cards may be used as winning hands for the card game; (d) the winning hands may be associated with any suitable credit payouts for the card game; and (e) any suitable quantity of paytables may be used for the card game.

Figure 3A:
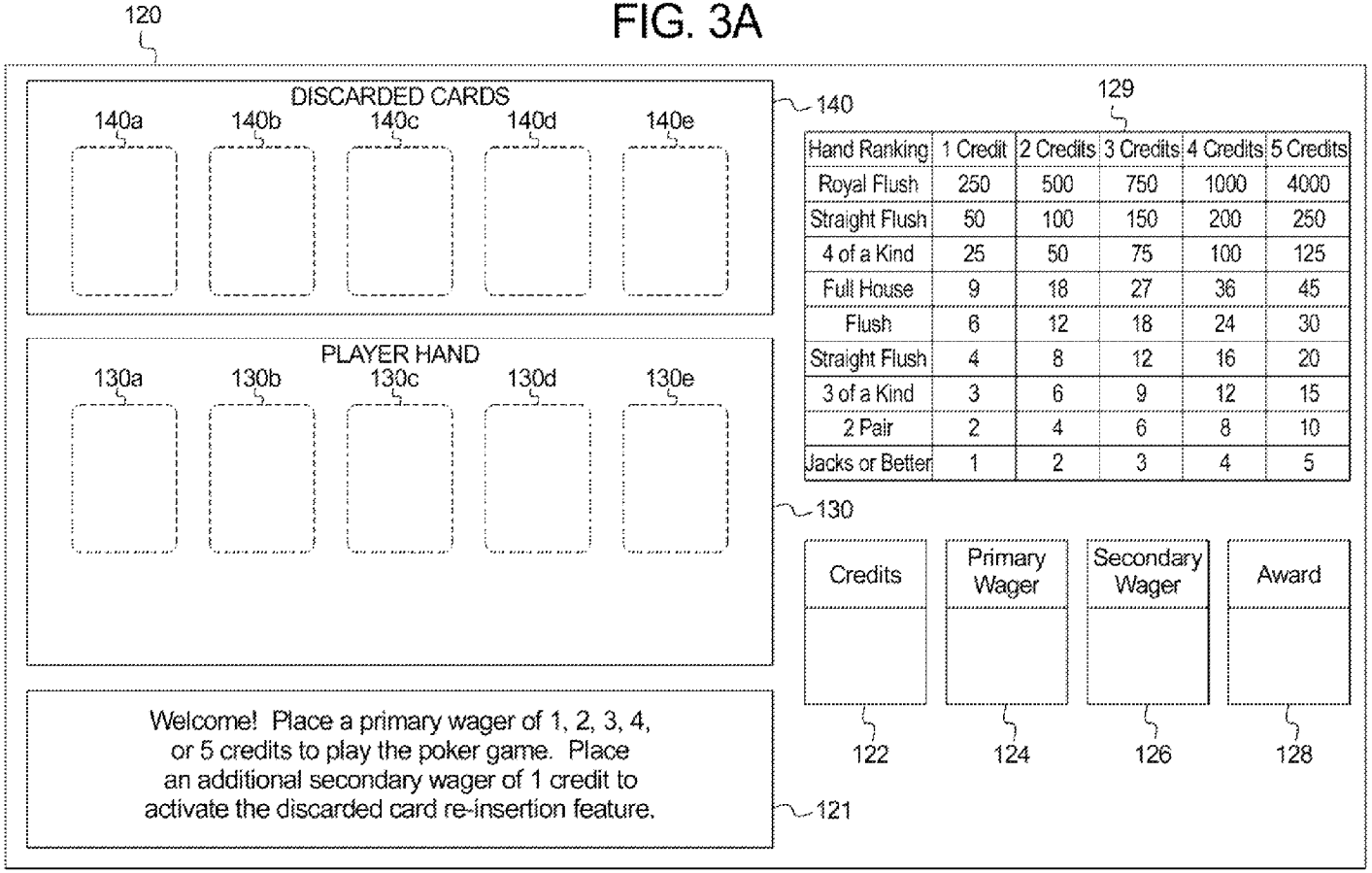
FIGS. 3A, 3B, 3C, 3D, 3E, 3F, and 3G are front views of a display device of one embodiment of the gaming system of the present disclosure, and illustrate example plays of an embodiment of the card game including a discarded card re-insertion feature.

As illustrated in FIG. 3A, when the gaming system is not being played, message display areas 121 displays a message that invites a player to place a primary wager of 1, 2, 3, 4, or 5 credits (in this example) for a play of the card game. The message also invites the player to place an additional secondary wager of 1 credit to activate the discarded card re-insertion feature.

Figure 3B:
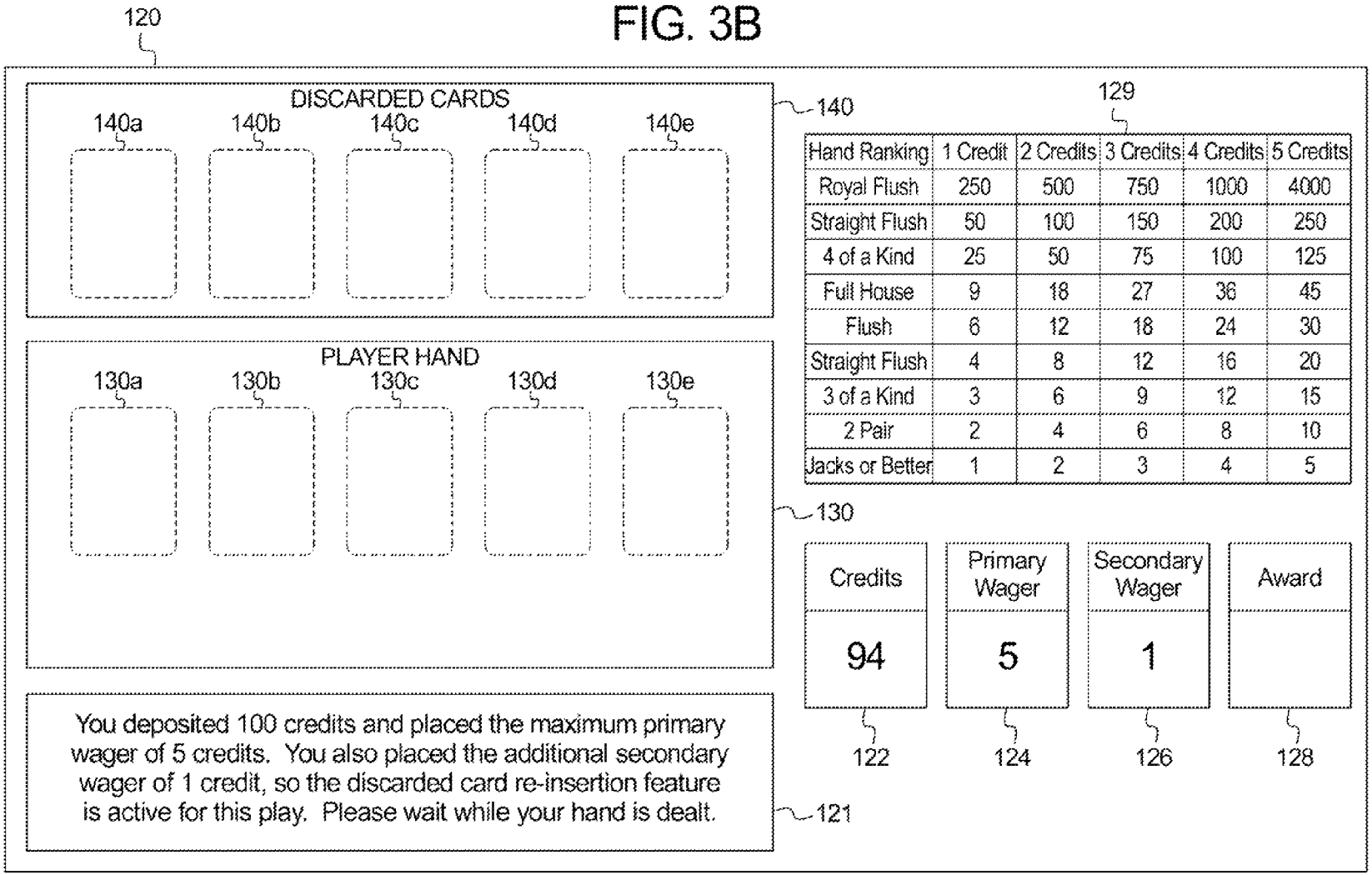

As illustrated in FIG. 3B, the player deposits currency and is provided with 100 credits, which are indicated in credit meter 122. As displayed in message display area 121, the player initiates a play of the card game by placing a primary wager of 5 credits, which is indicated in primary wager indicator 124, and a secondary wager of 1 credit, which is indicated in secondary wager indicator 126. Since the player placed the secondary wager for this play of the card game, the discarded card re-insertion feature is active for this play of the card game. Message display area 121 displays a notification that the discarded card re-insertion feature is active for this play of the card game. The player's total remaining credit balance of 94 credits (i.e., the player's initial credit balance of 100 credits minus the player's primary wager of 5 credits and minus the player's secondary wager of 1 credit) is indicated by credit meter 122.

Figure 3C:
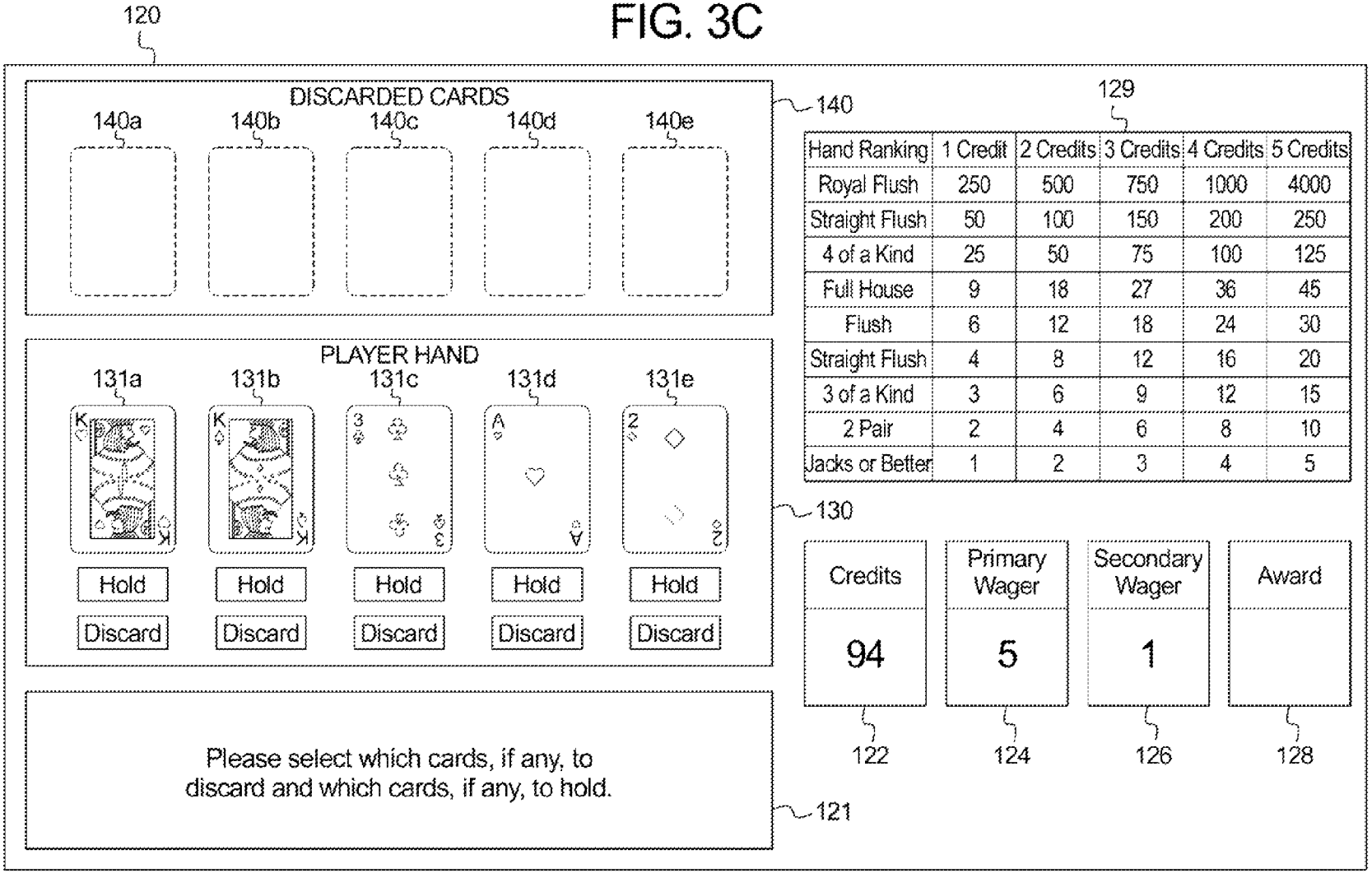

As illustrated in FIG. 3C, the gaming system randomly selects and displays one of the cards from the set of cards at each of the player card display areas to form a player's first hand. Specifically, in this example, the gaming system: (a) randomly selects king of hearts 131*a* and displays that card at player card display area 130*a*, (b) randomly selects king of spades 131*b* and displays that card at player card display area 130*b*, (c) randomly selects three of clubs 131*c* and displays that card at player card display area 130*c*, (d) randomly selects ace of hearts 131*d* and displays that card at player card display area 130*d*, and (e) randomly selects two of diamonds 131*e* and displays that card at player card display area 130*e*. At this point, for each of the cards in the player's first hand, the gaming system enables the player to hold or discard that card. The gaming system enables the player to do so in any of a variety of suitable manners, such as by using a touch screen to select a "hold" or "discard" button associated with each of the cards in the player's first hand (as shown in FIG. 3C) or by actuating designated physical "hold" or "discard" buttons of the gaming system (not shown).

Figure 3D:
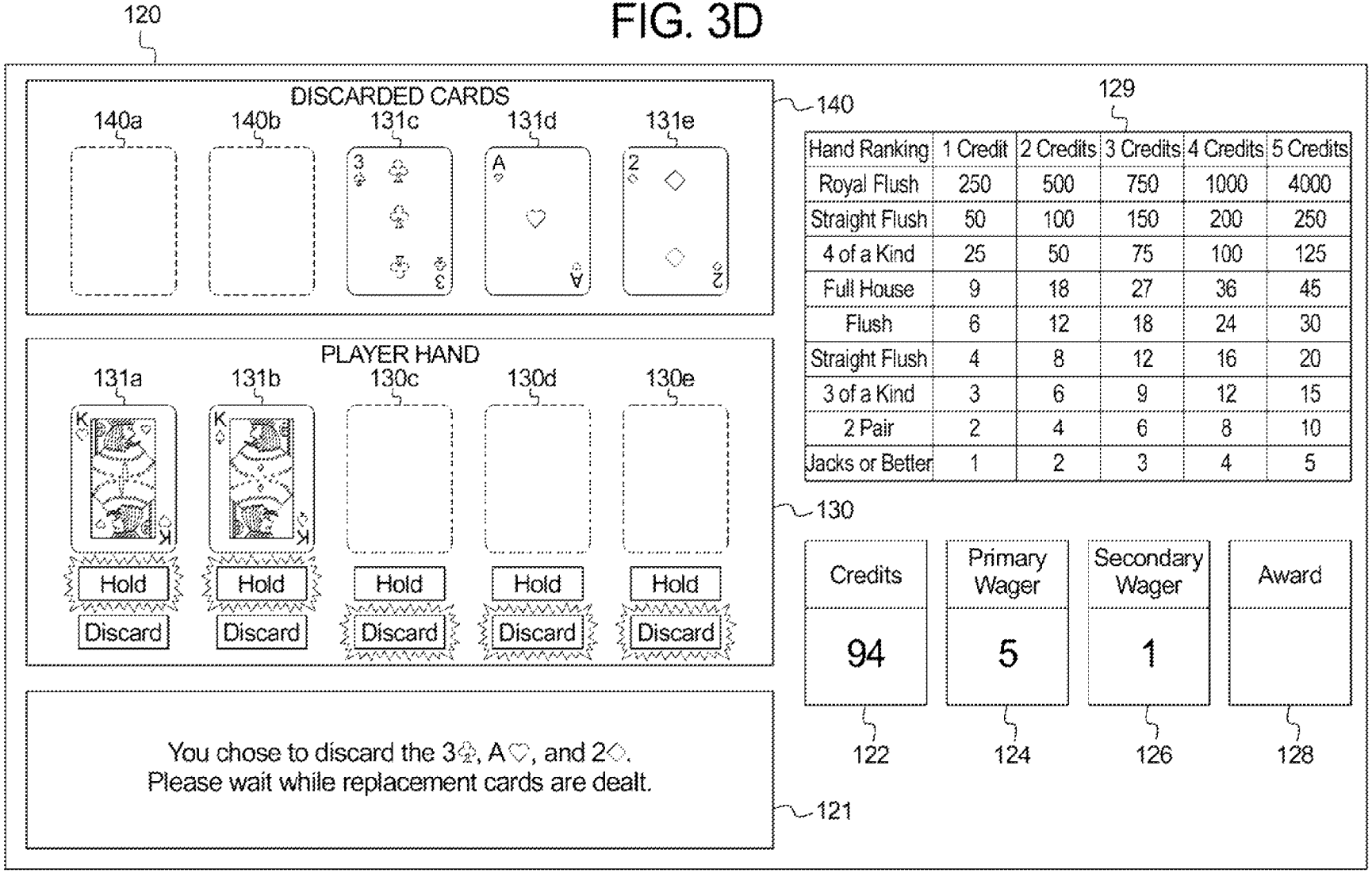

As illustrated in FIG. 3D, in this example the player chooses to: (a) hold king of hearts 131*a* and king of spades 131*b*; and (b) discard three of clubs 131*c*, ace of hearts 131*d*, and two of diamonds 131*e*. The gaming system removes each discarded card from the player card display area at which that card is displayed, and displays each discarded card in the discarded card display area vertically adjacent to the player card display area at which that discarded card was previously displayed. Thus, in this example, the gaming system removes three of clubs 131*c* from player card display area 130*c* and displays that card at discarded card display area 140*c*, removes ace of hearts 131*d* from player card display area 130*d* and displays that card at discarded card display area 140*d*, and removes two of diamonds 131*e* from player card display area 130*e* and displays that card at discarded card display area 140*e*.

Figure 3E:
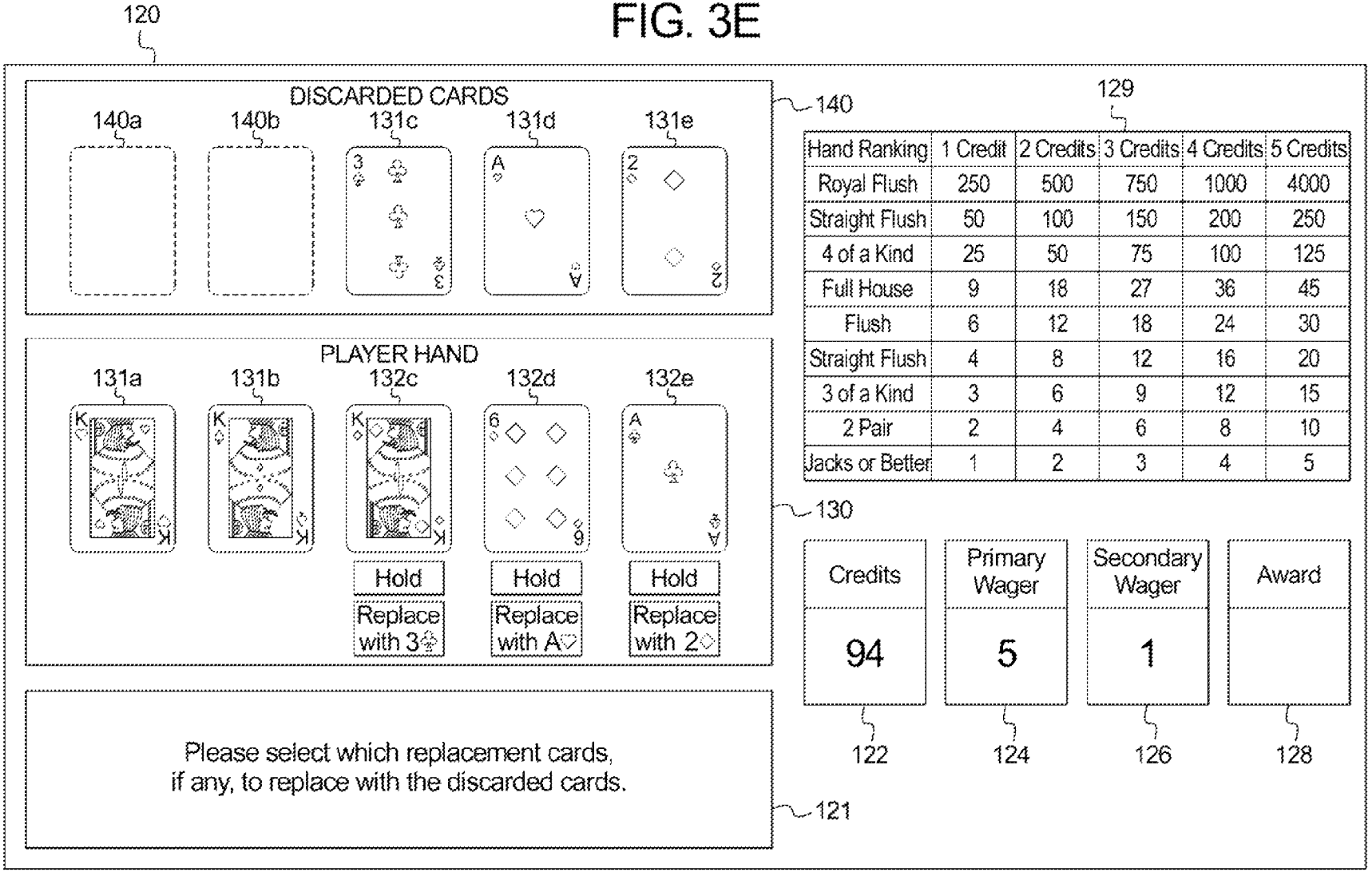

As illustrated in FIG. 3E, the gaming system randomly selects and displays a replacement card at each empty player card display area to form a player's second hand. The gaming system randomly selects the replacement card or cards from the cards remaining in the set of cards (i.e., the cards remaining in the set of cards following the removal of each of the cards in the player's first hand from the set of cards). In this example, the gaming system: (a) randomly selects king of diamonds 132*c* and displays that card at player card display area 130*c*, (b) randomly selects six of diamonds 132*d* and displays that card at player card display area 130*d*, and (c) randomly selects ace of dubs 132*e* and displays that card at player card display area 130*e*.

Since the player placed the secondary wager to activate the discarded card re-insertion feature, at this point the gaming system enables the player to replace each of zero, one, or a plurality of the replacement cards (i.e., king of diamonds 132*c*, six of diamonds 132*d*, and/or ace of clubs 132*e* in this example) with the discarded cards that those replacement cards replaced (i.e., three of clubs 131*e*, ace of hearts 131*d*, and/or two of diamonds 131*e*, respectively, in this example). The gaming system enables the player to do so in any suitable manner, such as those described above.

Figure 3F:
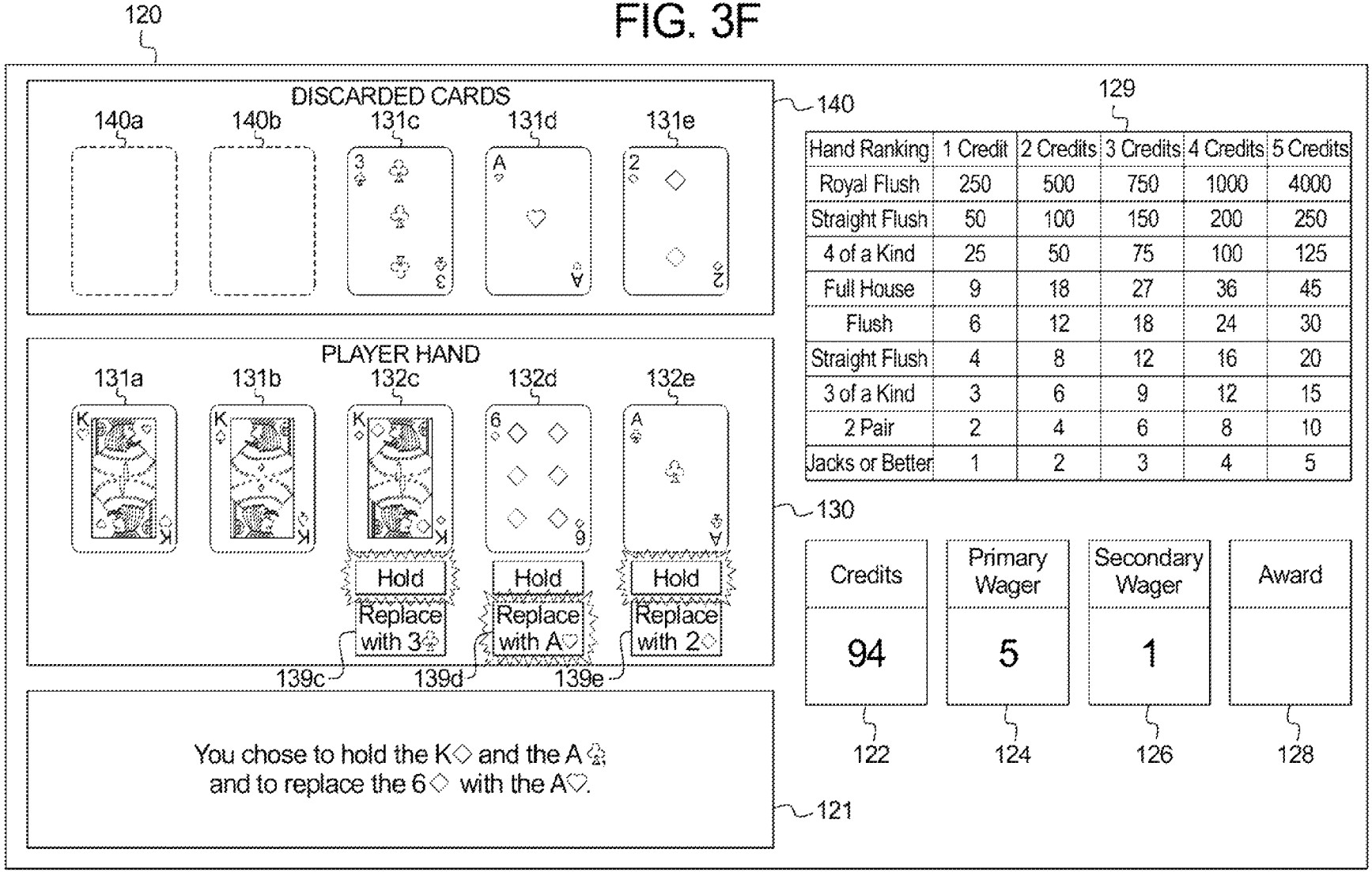

As illustrated in FIG. 3F, in this example the player chooses to: (a) hold king of diamonds 132*c* and ace of clubs 132*e* (i.e., not replace king of diamonds 132*c* or ace of clubs 132*e*), and (b) replace six of diamonds 132*d*. Since, in this example, six of diamonds 132*d* replaced discarded ace of hearts 131*d*, the gaming system replaces six of diamonds 132*d* with ace of hearts 131*d*.

Figure 3G:
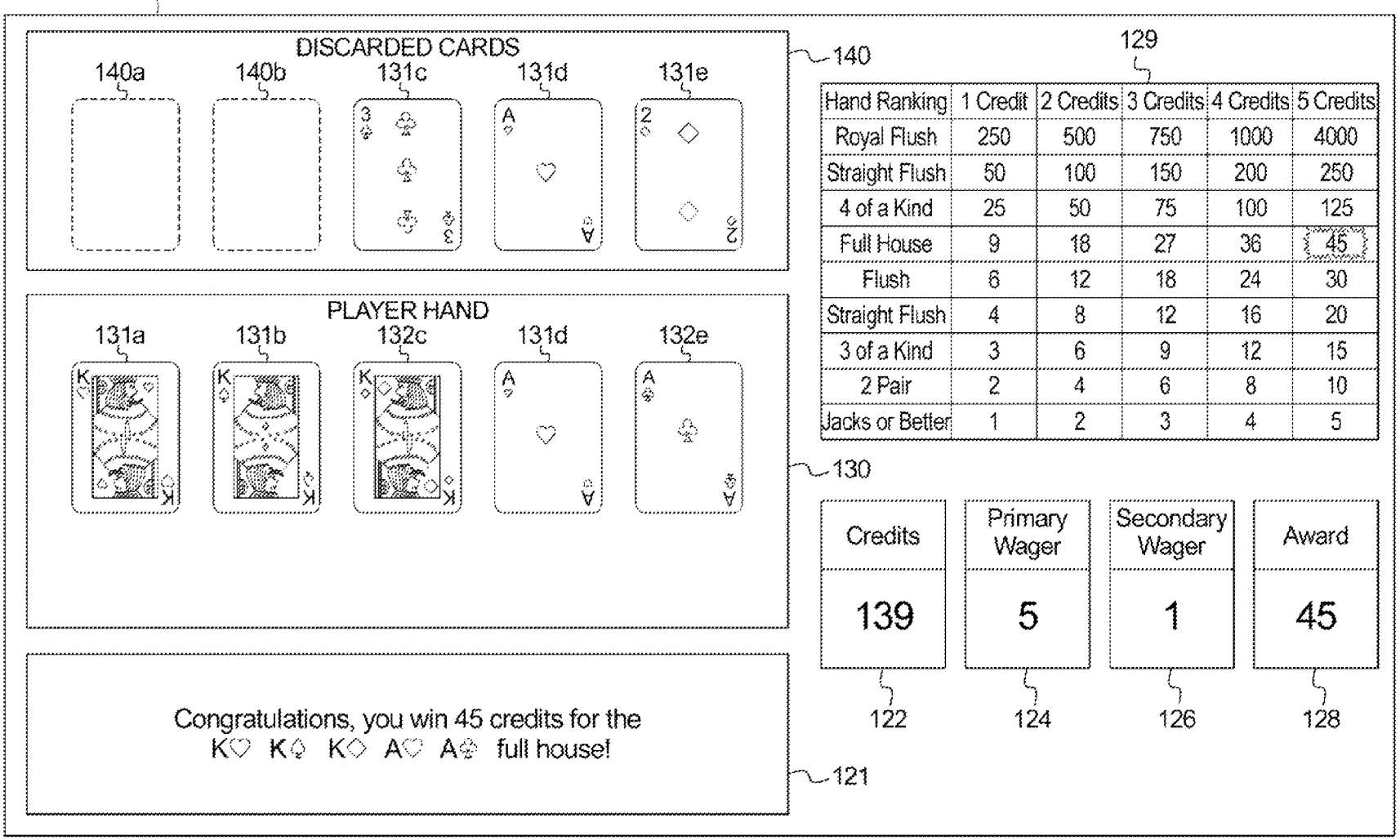

Accordingly, as illustrated in FIG. 3G, the gaming system removes six of diamonds 132*d* from player card display area 130*d* and displays ace of hearts 131*d* at player card display area 130*d* to form a player's third hand. After forming the player's third hand, the gaming system makes an award determination based on the cards included in the player's third hand. That is, the gaming system determines whether the cards included in the player's third hand form any of the winning hands included in paytable 129. As indicated by the message displayed in message display area 121, in this example cards in the player's third hand form a full house and, since the player placed a primary wager of 5 credits, the player wins 45 credits for that winning hand. The player's 45 credit award is indicated by award indicator 128, and the player's credit balance indicated in credit meter 122 is updated to reflect the player's new credit balance of 139 credits (i.e., the player's previous credit balance of 94 credits plus the player's award of 45 credits).

Figure 4:
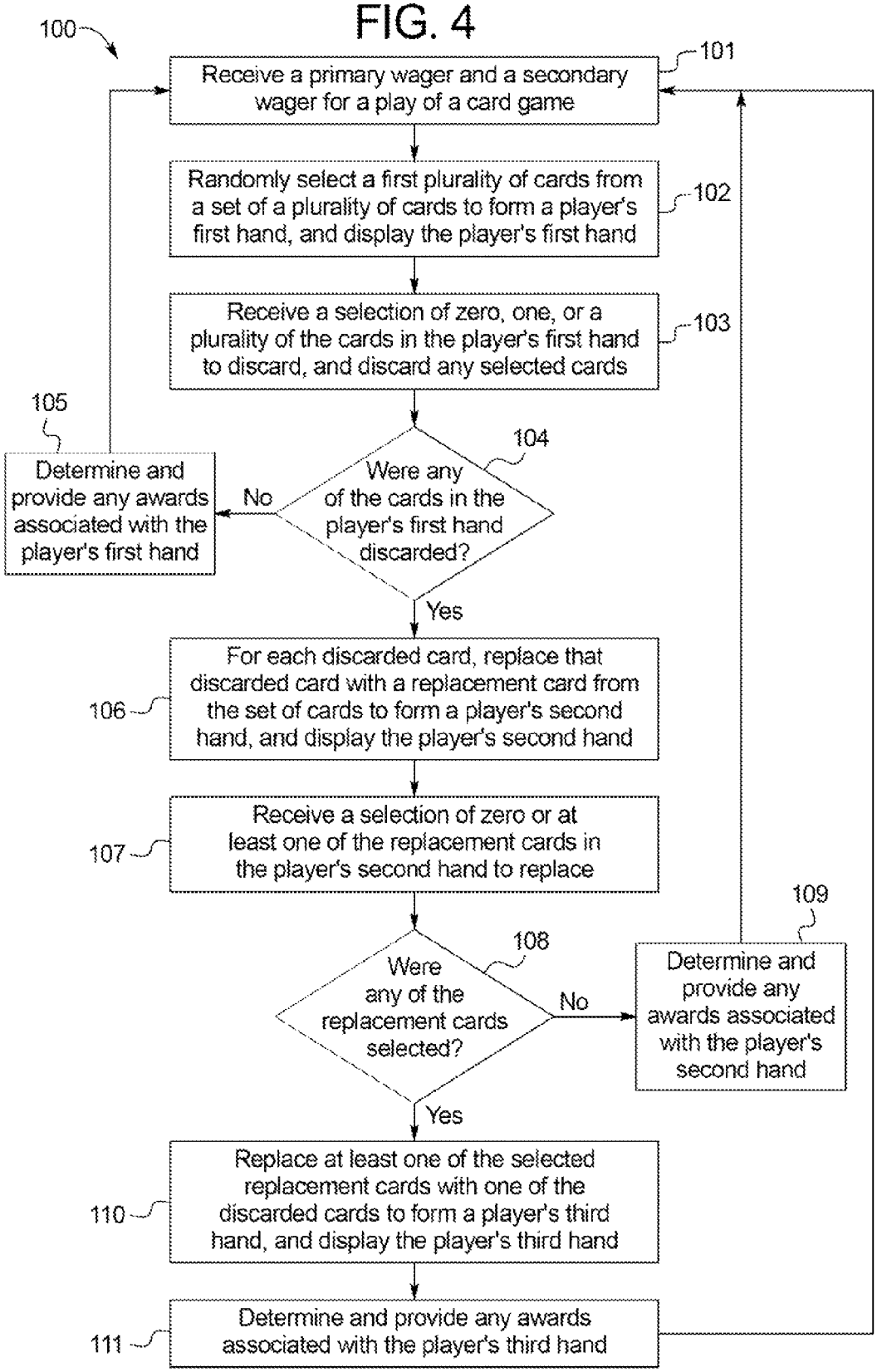
FIG. 4 is a flowchart illustrating an example method of operating gaming system of one embodiment of the present disclosure.

FIG. 4 illustrates a flowchart of an example of a process or method 100 for operating a gaming system of the present disclosure. In one embodiment, this process 100 is represented by a set of instructions stored in one or more memories and executed by one or more processors or controllers. Although this process 100 is described with reference to the flowchart shown in FIG. 4, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In operation of one embodiment, the gaming system receives a primary wager and a secondary wager for a play of a card game, as indicated by block 101. the gaming system randomly selects a first plurality of cards from a set of a plurality of cards to form a player's first hand, and displays the player's first hand, as indicated by block 102. The gaming system receives a selection of zero, one, or a plurality of the cards in the player's first hand to discard, and discards any selected cards, as indicated by block 103. The gaming system determines whether at least one of the cards in the player's first hand was discarded, as indicated by diamond 104. If none of the cards in the player's first hand were discarded, the gaming system determines and provides any awards associated with the player's first hand, as indicated by block 105, and process 100 returns to block 101.

If at least one of the cards in the player's first hand was discarded, for each discarded card, the gaming system replaces that discarded card with a replacement card from the set of cards to form a player's second hand, and displays the player's second hand, as indicated by block 106. The gaming system receives a selection of zero or at least one of the replacement cards in the player's second hand to replace, as indicated by block 107. The gaming system determines whether any of the replacement cards were selected, as indicated by diamond 108. If none of the replacement cards were selected, the gaming system determines and provides any awards associated with the player's second hand, as indicated by block 109, and process 100 returns to block 101.

If at least one of the cards in the player's first hand was selected, the gaming system replaces at least one of the selected replacement cards with one of the discarded cards to form a player's third hand, and displays the player's third hand, as indicated by block 110. The gaming system determines and provides any awards associated with the player's third hand as indicated by block 111, and process 100 returns to block 101.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one display device;

at least one input device;

at least one processor; and at least one memory device that stores a plurality of instructions which, when executed by the at least one processor, cause the at least one processor to operate with the at least one display device and the at least one input device to, for a play of a draw poker game:

(a) display a first plurality of cards forming a player hand;

(b) receive from a player a selection of one of: zero of the displayed cards, one of the displayed cards, and a plurality of the displayed cards in the player hand to discard;

(c) discard any non-selected cards in the player hand;

(d) replace any discarded cards in the player hand with one or more replacement cards; and (e) if any cards in the player hand were discarded and replaced, receive from the player a selection of one of the discarded cards and re-insert the selected discarded card into the player hand.

2. The gaming system of claim 1, wherein the plurality of instructions, when executed by the at least one processor, cause the at least one processor to, if any cards in the player hand were discarded and replaced, re-insert the selected discarded card into the player hand in place of the replacement card that replaced said selected discarded card.

3. The gaming system of claim 1, wherein the plurality of instructions, when executed by the at least one processor, cause the at least one processor to, if any cards in the player hand were discarded and replaced, re-insert the selected discarded card into the player hand in place of a randomly selected replacement card.

4. The gaming system of claim 1, wherein the plurality of instructions, when executed by the at least one processor, cause the at least one processor to provide (a) to (d) upon placement of a primary wager and to provide (a) to (e) upon placement of the primary wager and an additional wager.

5. The gaming system of claim 4, wherein the plurality of instructions, when executed by the at least one processor, cause the at least one processor to operate with the at least one input device to receive the additional wager before displaying the first plurality of cards.

6. The gaming system of claim 4, wherein the plurality of instructions, when executed by the at least one processor, cause the at least one processor to operate with the at least one input device to receive the additional wager after displaying the first plurality of cards.

7. A method of operating a gaming system, said method comprising:

for a play of a draw poker game:

(a) causing at least one processor to execute a plurality of instructions stored in at least one memory device to operate with at least one display device to display a first plurality of cards forming a player hand;

(b) causing the at least one processor to execute the plurality of instructions to operate with at least one input device to receive from a player a selection of one of: zero of the displayed cards, one of the displayed cards, and a plurality of the displayed cards in the player hand to discard;

(c) causing the at least one processor to execute the plurality of instructions to discard any non-selected cards in the player hand;

(d) causing the at least one processor to execute the plurality of instructions to replace any discarded cards in the player hand with one or more replacement cards; and (e) if any cards in the player hand were discarded and replaced, causing the at least one processor to execute the plurality of instructions to operate with the at least one input device to receive from the player a selection of one of the discarded cards and re-insert the selected discarded card into the player hand.

8. The method of claim 7, which includes causing the at least one processor to execute the plurality of instructions to, if any cards in the player hand were discarded and replaced, re-insert the selected discarded card into the player hand in place of the replacement card that replaced said selected discarded card.

9. The method of claim 7, which includes causing the at least one processor to execute the plurality of instructions to, if any cards in the player hand were discarded and replaced, re-insert the selected discarded card into the player hand in place of a randomly selected replacement card.

10. The method of claim 7, which includes providing (a) to (d) upon placement of a primary wager and providing (a) to (e) upon placement of the primary wager and an additional wager.

11. The method of claim 10, which includes causing the at least one processor to execute the plurality of instructions to operate with the at least one input device to receive the additional wager before displaying the first plurality of cards.

12. The method of claim 10, which includes causing the at least one processor to execute the plurality of instructions to operate with the at least one input device to receive the additional wager after displaying the first plurality of cards.

13. The method of claim 7, which is provided through a data network.

14. The method of claim 13, wherein the data network is an internet.

15. A non-transitory computer readable medium storing a plurality of instructions which, when executed by at least one processor, cause the at least one processor to, for a play of a draw poker game:

(a) cause at least one display device to display a first plurality of cards forming a player hand;

(b) operate with at least one input device to receive from a player a selection of one of: zero of the displayed cards, one of the displayed cards, and a plurality of the displayed cards in the player hand to discard;

(c) discard any non-selected cards in the player hand;

(d) replace any discarded cards in the player hand with one or more replacement cards; and (e) if any cards in the player hand were discarded and replaced, operate with the at least one input device to receive from the player a selection of one of the discarded cards and re-insert the selected discarded card into the player hand.

16. The non-transitory computer readable medium of claim 15, wherein the plurality of instructions, when executed by the at least one processor, cause the at least one processor to, if any cards in the player hand were discarded and replaced, re-insert the selected discarded card into the player hand in place of the replacement card that replaced said selected discarded card.

17. The non-transitory computer readable medium of claim 15, wherein the plurality of instructions, when executed by the at least one processor, cause the at least one processor to, if any cards in the player hand were discarded and replaced, re-insert the selected discarded card into the player hand in place of a randomly selected replacement card.

18. The non-transitory computer readable medium of claim 15, wherein the plurality of instructions, when executed by the at least one processor, cause the at least one processor to provide (a) to (d) upon placement of a primary wager and to provide (a) to (e) upon placement of the primary wager and an additional wager.

19. The non-transitory computer readable medium of claim 18, wherein the plurality of instructions, when executed by the at least one processor, cause the at least one processor to operate with the at least one input device to receive the additional wager before displaying the first plurality of cards.

20. The non-transitory computer readable medium of claim 18, wherein the plurality of instructions, when executed by the at least one processor, cause the at least one processor to operate with the at least one input device to receive the additional wager after displaying the first plurality of cards.

* * * * *